US011576532B2

(12) United States Patent
Lovelace et al.

(10) Patent No.: US 11,576,532 B2
(45) Date of Patent: Feb. 14, 2023

(54) BATHTUB PLATFORM INSERT

(71) Applicant: IP 2 Market, LLC, Pottsboro, TX (US)

(72) Inventors: Casie Lovelace, Pottsboro, TX (US); Staci Wright, Pottsboro, TX (US); Lauren R. Skidmore, Pottsboro, TX (US); James M. Behmke, Pembroke, MA (US); Brian J. Hickey, Centereach, NY (US)

(73) Assignee: IP 2 MARKET, LLC, Pottsboro, TX (US)

( * ) Notice: Subject to any disclaimer, the term of this patent is extended or adjusted under 35 U.S.C. 154(b) by 100 days.

(21) Appl. No.: 17/242,283

(22) Filed: Apr. 27, 2021

(65) Prior Publication Data

US 2021/0330133 A1 Oct. 28, 2021

Related U.S. Application Data

(60) Provisional application No. 63/015,763, filed on Apr. 27, 2020.

(51) Int. Cl.
*A47K 3/12* (2006.01)
*A47K 3/00* (2006.01)

(52) U.S. Cl.
CPC ..... *A47K 3/125* (2013.01); *A47K 3/003* (2013.01)

(58) Field of Classification Search
CPC ..... A47K 3/125; A47K 3/003; A47K 3/147; A47K 3/12
USPC ..... 4/571.1
See application file for complete search history.

(56) References Cited

U.S. PATENT DOCUMENTS 602,125 A * 4/1898 Burrows ..... A47K 3/122 182/119
658,084 A * 9/1900 Grimmell ..... A47K 3/122 4/579
736,032 A * 8/1903 Silver ..... A47K 3/122 297/251

(Continued)

OTHER PUBLICATIONS

Kohler Whirlpool or Air Bath Foot Stops, online, accessed Apr. 29, 2020, 2 pages, Lowes.com.

(Continued)

*Primary Examiner* — Benjamin R Shaw
(74) *Attorney, Agent, or Firm* — Behmke Innovation Group LLC; James M. Behmke; Jonathon P. Western

(57) ABSTRACT

A bathtub platform insert is described herein (e.g., a footrest, backrest, or table). For example, a bathtub footrest insert herein allows a bather to adjust the length of the "sitting portion" of the bathtub, by securely inserting the bathtub footrest to establish a customizable distance between a backrest of the bathtub to the footrest, such that a bather of shorter height may comfortably stay above the water while soaking in a bathtub. In one embodiment, an example bathtub platform insert herein may comprise: a support surface; adjustable securing members extending outwardly widthwise from the support surface; and gripping end pieces on each end of the adjustable securing members; wherein the adjustable securing members are adjustable to extend an overall width of the bathtub platform insert between opposing pairs of gripping end pieces to secure the opposing pairs of gripping end pieces against a wall of a bathtub.

20 Claims, 36 Drawing Sheets

(56) References Cited

U.S. PATENT DOCUMENTS

| | | | | | |
|---|---|---|---|---|---|
| 754,369 | A * | 3/1904 | Harbour | A47K 3/122 | 4/579 |
| 5,491,850 | A * | 2/1996 | Kiester | A47K 3/127 | 4/572.1 |
| 5,682,626 | A * | 11/1997 | Banks, Jr | A47K 3/122 | 4/579 |
| 6,804,842 | B1 * | 10/2004 | Johnson | A47K 3/122 | 4/578.1 |
| 2017/0325600 | A1 * | 11/2017 | Kaplan | A47D 1/08 | |
| 2018/0325324 | A1 * | 11/2018 | Fusco | A47K 3/122 | |
| 2019/0019391 | A1 * | 1/2019 | Chang | G08B 21/02 | |
| 2019/0099044 | A1 * | 4/2019 | Cooper | A47K 3/003 | |

OTHER PUBLICATIONS

Kohler Installation Instructions: Foot Stop, Brochure 86110-2-AA(-), 1999, 2 pages, Kohler Co., Kohler, Wisconsin.

Kohler K-1601-7 Bath/Whirlpool Removable Footstop, Black, online, accessed Apr. 29, 2020, 7 pages, Amazon.com.

Shower Foot Rest, Shaving & Washing Foot Rest, Heavy Duty Aluminum Alloy Shaving Shelf Fold-Up Shower Foot Rest for Shaving Legs, accessed Apr. 29, 2020, 8 pages, Amazon.com.

MedGear Multi-Functional Bath Tub Foot Rest, Back Rest, or Seat, Item No. A-0206B1, online, accessed Apr. 29, 2020, 5 pages, Construction Concepts International.

Bath Footrest, online, accessed Apr. 29, 2020, 2 pages, https://www.welcomemobility.co.uk/.

Mobeli Bath Tub Shortner, online, Accessed Apr. 29, 2020, 3 pages, https://www.welcomemobility.co.uk/.

* cited by examiner

BATHTUB PLATFORM INSERT

RELATED APPLICATION

This application claims priority to U.S. Provisional Application No. 63/015,763, filed Apr. 27, 2020, entitled BATHTUB FOOTREST INSERT, by Casie Lovelace, et al., the contents of which are incorporated herein by reference.

TECHNICAL FIELD

The present disclosure relates generally to bathtub accessories, and, more particularly, to an insertable bathtub platform, such as a footrest or table.

BACKGROUND

Though bathing in tubs has been a part of human culture for thousands of years, it is only within the past 150 years that the modern style of bathtubs has truly become widespread. From late 1800's clawfoot tubs to today's contemporary designs and materials, however, the overall dimensions of a typical bathtub is generally based on a "one-size-fits-most" consideration.

Many individuals, however, have a hard time soaking and relaxing in bathtubs because their feet do not reach the end of the tub. Such bathers are continually having to prop themselves up or not fill the bathtub up all the way in order to keep their head above the water level. As an alternative, people simply just do not take baths.

SUMMARY

According to one or more embodiments of the disclosure, the device and techniques introduced herein relate to a bathtub platform insert. In particular, as described herein, certain embodiments of the present disclosure relates to a bathtub footrest (or "foot stop") that allows a bather to effectively adjust the length of the "sitting portion" of the bathtub. That is, by securely inserting the bathtub footrest herein, a user can establish a customizable distance between a backrest of the bathtub to the footrest. In this manner, a bather of shorter height may have adequate foot support to allow them to comfortably stay above the water while soaking in a bathtub. Other embodiments herein also allow the platform insert to be used as a height-adjustable table.

Specifically, according to the present disclosure, an example bathtub platform insert herein may comprise a support surface (e.g., a flat surface), such as for the bather's feet to rest on, and one or more securing members that can be adjusted to fit any tub, securing the footrest in a desired position using the walls of the bathtub. For example, the support members may be adjustable (e.g., tension rods, straps, extending legs, etc.) so that it can rest in differently sized bathtub widths, and at different positions within the length of the tub to create shorter or longer sitting portion lengths in the tub to accommodate different needs of the bather depending on their size/height. In certain embodiments the platform is held in place with tension, while in other embodiments the platform is held in place with suction cups or other attachment mechanisms. In still another embodiment, the bathtub platform insert rests on the bottom of the bathtub, and/or has one or more securing/support members extending from the rear of the platform, such as to support it against pressure from the feet of the bather.

Other embodiments are described herein, including various textures, accessories, and so on, and this summary is not meant to be limiting to scope of the present disclosure.

BRIEF DESCRIPTION OF THE DRAWINGS

The embodiments herein may be better understood by referring to the following description in conjunction with the accompanying drawings in which like reference numerals indicate identically or functionally similar elements, of which.

DESCRIPTION OF EXAMPLE EMBODIMENTS

Figure 1A:
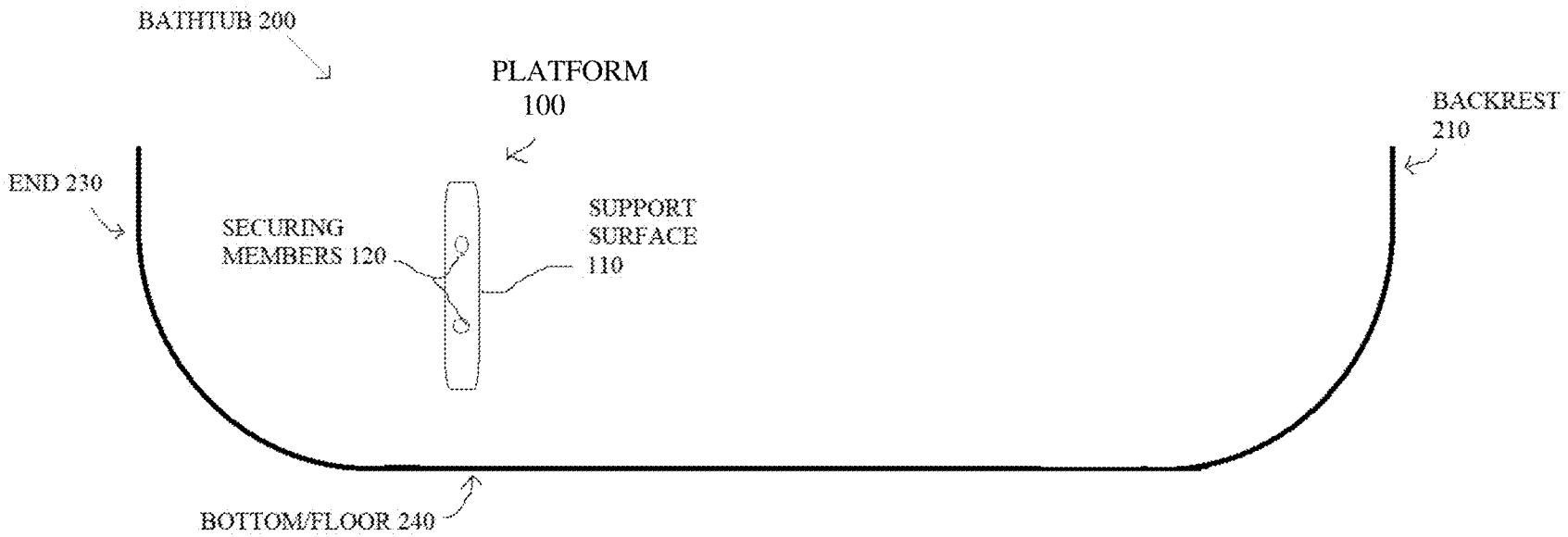
FIGS. 1A-1B illustrate an example of a bathtub platform insert (e.g., footrest) in accordance with one or more embodiments of the present disclosure.

As noted above, bathing in tubs has been a part of human culture for thousands of years, with the modern style of bathtubs become widespread since the late 1800's. As also noted, however, the overall dimensions of a typical bathtub is generally based on a "one-size-fits-most" consideration. For example, a typical standard bathtub measures approximately 60 inches long, and is 30-32 inches wide. Some larger-sized bathtubs can measure up to 72 inches long and up to 42 inches wide. (Note, too, that the shapes of bathtubs can vary greatly, including intricate designs, various angles, armrests/shelves, and so on.)

When taking a bath, it is imperative for survival for a bather to be able to keep their head above water. Additionally, in order to enjoy taking a relaxing bath, it is still important to be able to comfortably keep one's head above water without continual effort. Many individuals, however, have a hard time soaking and relaxing in bathtubs because their feet do not reach the end of the tub. This may be because they are shorter than the average adult, are youths, or have an oversized bathtub. Regardless, such bathers are continually having to prop themselves up or not fill the bathtub up all the way in order to keep their head above the water level. As an alternative, people simply just do not take baths.

Currently, there is nothing in the market to specifically address this problem. Although there are step stools and other aids to help individuals reach items that they are not tall enough to reach, when it comes to taking a bath, there is nothing available that would help people of different sizes to comfortably achieve an appropriate fit in a fixed-size bathtub.

Additionally, current bath tables, trays, or shelves are lacking in that they typically hang from the top ledge of the bathtub, and are located at a static height. That is, due to the different sizes of bathtubs and people, having a bathtub tray that is merely designed to rest on the top of the bathtub may not account for all possible widths and designs of bathtubs, and may be far too high for many bathers to bother with their use.

According to one or more embodiments of the disclosure, therefore, the device and techniques introduced herein relate to a bathtub platform insert, such as for a footrest and/or a table (tray, shelf, etc.). In particular, as described herein, certain embodiments of the present disclosure relates to a bathtub footrest (or "foot stop") that allows a bather to effectively adjust the length of the "sitting portion" of the bathtub. That is, by securely inserting the bathtub footrest herein, a user can establish a customizable distance between a backrest of the bathtub to the footrest. In this manner, a bather of shorter height may have adequate foot support to allow them to comfortably stay above the water while soaking in a bathtub. Other embodiments herein also allow the platform insert to be used as a height-adjustable table.

Specifically, according to the present disclosure, an example bathtub platform insert herein may comprise a support surface (e.g., a flat surface), such as for the bather's feet to rest on, and one or more securing members that can be adjusted to fit any tub, securing the footrest in a desired position using the walls of the bathtub. For example, the support members may be adjustable (e.g., tension rods, straps, extending legs, etc.) so that it can rest in differently sized bathtub widths, and at different positions within the length of the tub to create shorter or longer sitting portion lengths in the tub to accommodate different needs of the bather depending on their size/height. In certain embodiments the platform is held in place with tension, while in other embodiments the platform is held in place with suction cups or other attachment mechanisms. In still another embodiment, the bathtub platform insert rests on the bottom of the bathtub, and/or has one or more securing/support members extending from the rear of the platform, such as to support it against pressure from the feet of the bather.

Figure 1B:
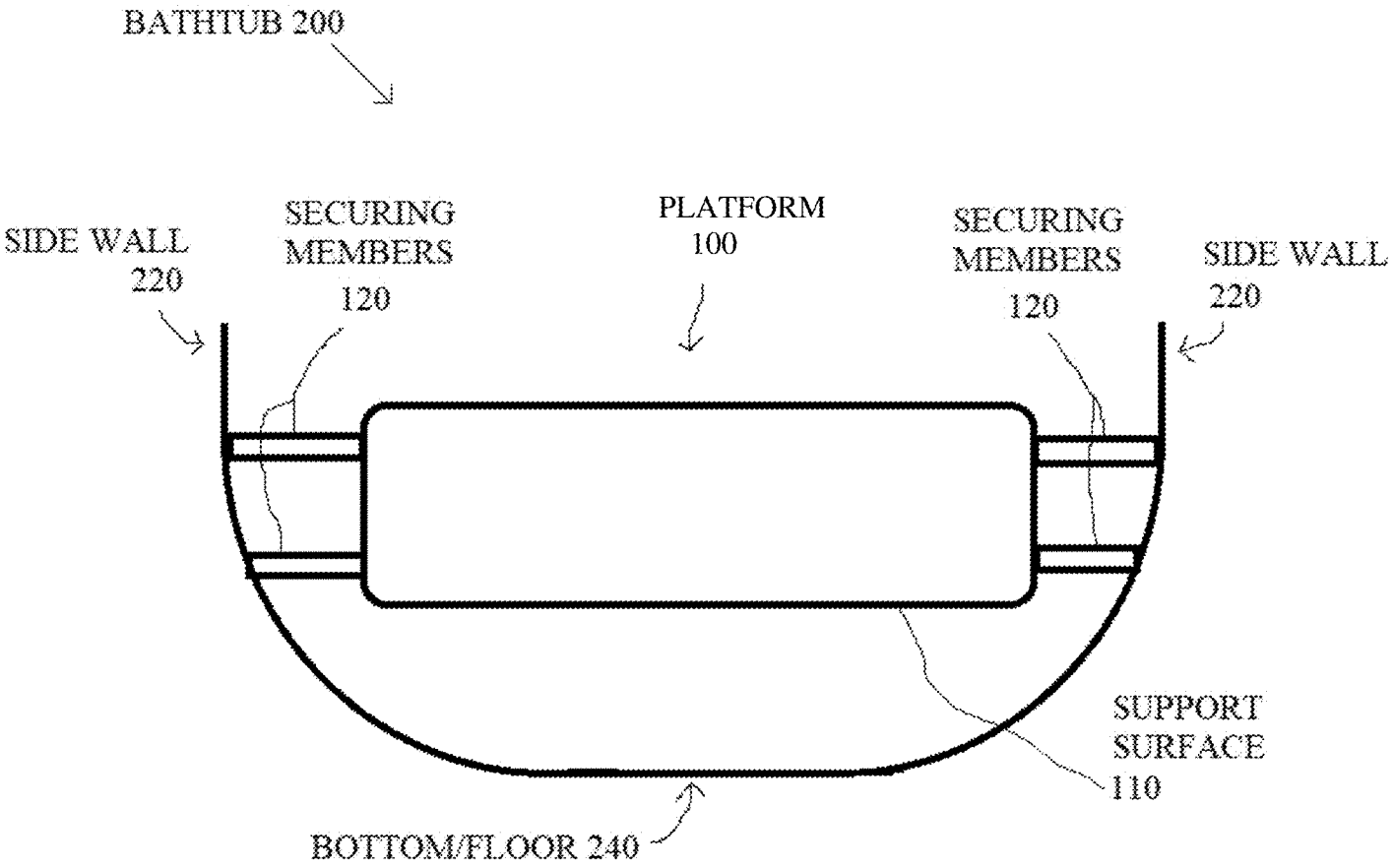

As shown in FIGS. 1A-1B, an example of a simplified bathtub platform insert 100 is illustrated, shown in a vertical orientation and arranged as a bathtub footrest insert. (Notably, the bathtub platform insert 100 may be arranged at any angle, from vertical to horizontal, and may be a footrest, backrest, table, shelf, calf rest, or any other use of an insertable platform as described herein. As such, the terms "platform", "footrest", "table", "shelf", etc., may be used interchangeably herein for "insert 100".) FIG. 1A illustrates a view of a bathtub 200 from the side (cutaway), while FIG. 1B illustrates a view of the bathtub 200 from the view of a bather within the tub looking at the platform (footrest) insert 100. Note also that the bathtub may have any typical shape or size (length, width, or height), including clawfoot, built-in, standard, oversized, custom, curved, squared-off, shelves, armrests, with/without air jets or water jets, and so on, and the simplified design and/or comparative scale shown herein is not meant to limit the scope of the embodiments herein. For reference, the bathtub may generally have a backrest 210, sides 220, an end 230 opposite the backrest, and a bottom/floor 240.

As shown, the illustrative bathtub platform insert 100 comprises a support surface (e.g., foot support surface) 110 and one or more securing members 120 connected to the support surface 110. In one particular embodiment, the support surface 110 is designed in a manner appropriate to allow the bather to rest his/her feet while sitting in the bathtub. Accordingly, such a platform/footrest could be any number of shapes including but not limited to rectangle or oval, a height suitable for supporting up to a typically large foot (e.g., 12-14 inches) and any appropriate width (within the limitation of the tub's width) so that the bather may comfortably rest their feet whether they are close together or far apart. The dimensions may vary generally depending on the desired aesthetics of the market, the age and size of the user, and any number of other factors. In certain embodiments, the dimensions may be adjustable as well (e.g., extending portions of the platform).

The materials used to make the platform may be selected from a set of waterproof or water-resistant materials, such as plastics, certain woods (e.g., teak), rust proof metals, carbon fiber, and/or rubber. Other components herein (e.g., securing members and extension portions, hooks, legs, end caps, covers, etc., as described below) may also be made of any suitable material for use in a bathtub, such as stainless steel, nylon, plastic, silicone, various fabrics, carbon fiber, and so on.

Figure 2:
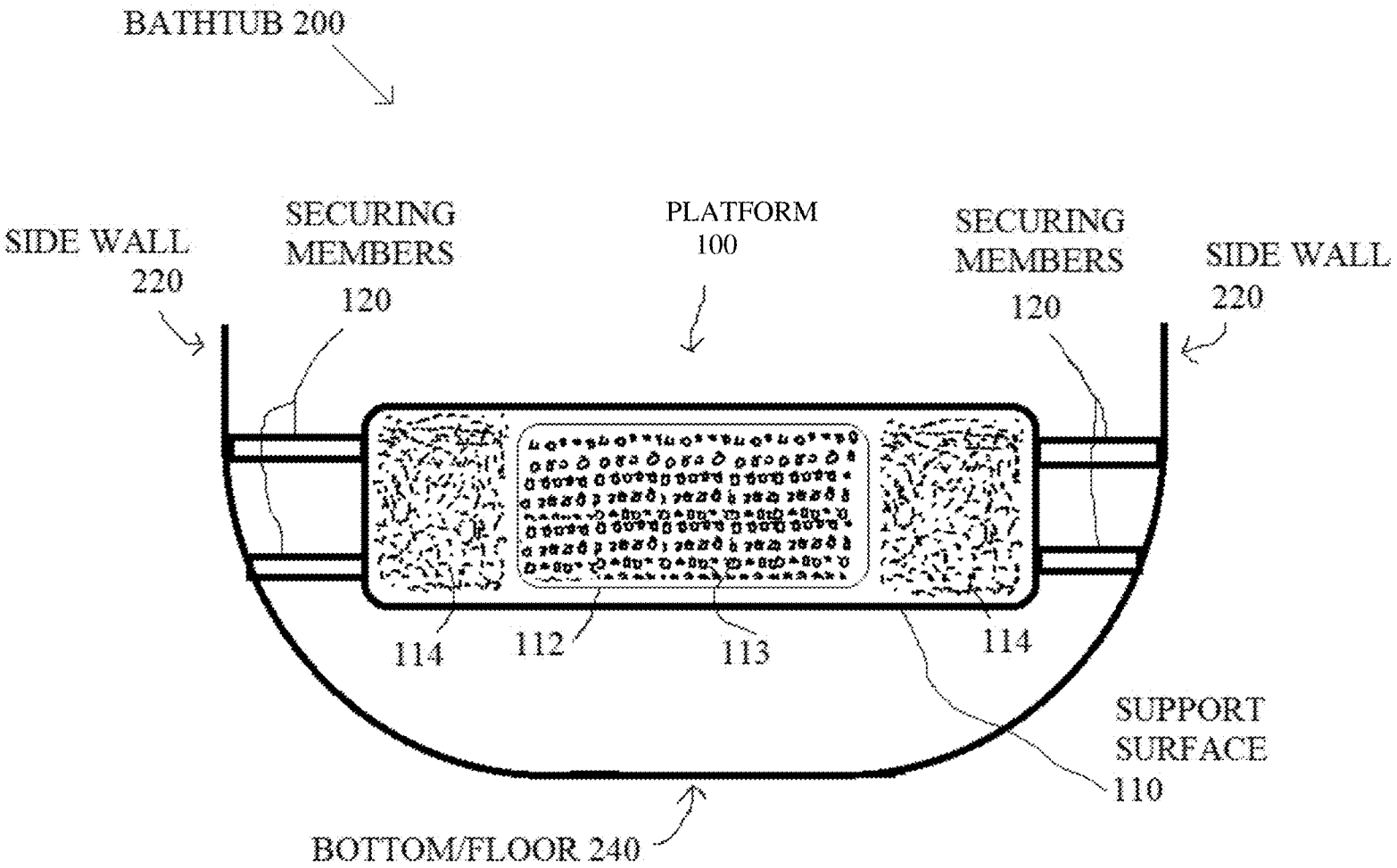
FIG. 2 illustrates another example of the bathtub platform insert with specific portions for the feet in accordance with one or more embodiments of the present disclosure.

The face of the support surface 110 (the side which would contact the bather's feet, back, or otherwise) may be made entirely of the same material and/or surface texture, or, as shown in FIG. 2, there may be a specific portion or portions 112 that have a different material and/or surface texture. For example, portion(s) 112 may comprise various foot pads made from a softer material than the rest of the support surface 110, such as a foam, rubber, gel pad, silicone, and so on. The support surface 110 and/or portion 112 may further comprise a plurality of foot massaging dimples 113 or other textured components for comfort. The support surface 110 and/or portion 112 may also comprise a gripping texture 114 to prevent slipping of the bather's wet feet (e.g., similar to a boat deck). For example, as shown, the support surface 110 may be a flat surface textured for grip (114), while the portions 112 may be made of a gel pad with massage dimples 113. The bather may then decide which portion of the footrest to rest their feet on at any given time during their bath.

Note that in one embodiment, the platform 100 may be reversable, meaning both sides of the surface 110 may be used to rest feet upon. In this manner, different materials and/or textures may be presented to the bather for different options during bathing, such as, e.g., a flat first side and a textured second side, and the bather would select which side faces his/her feet by merely installing the platform 100 in the desired direction.

Figure 3:
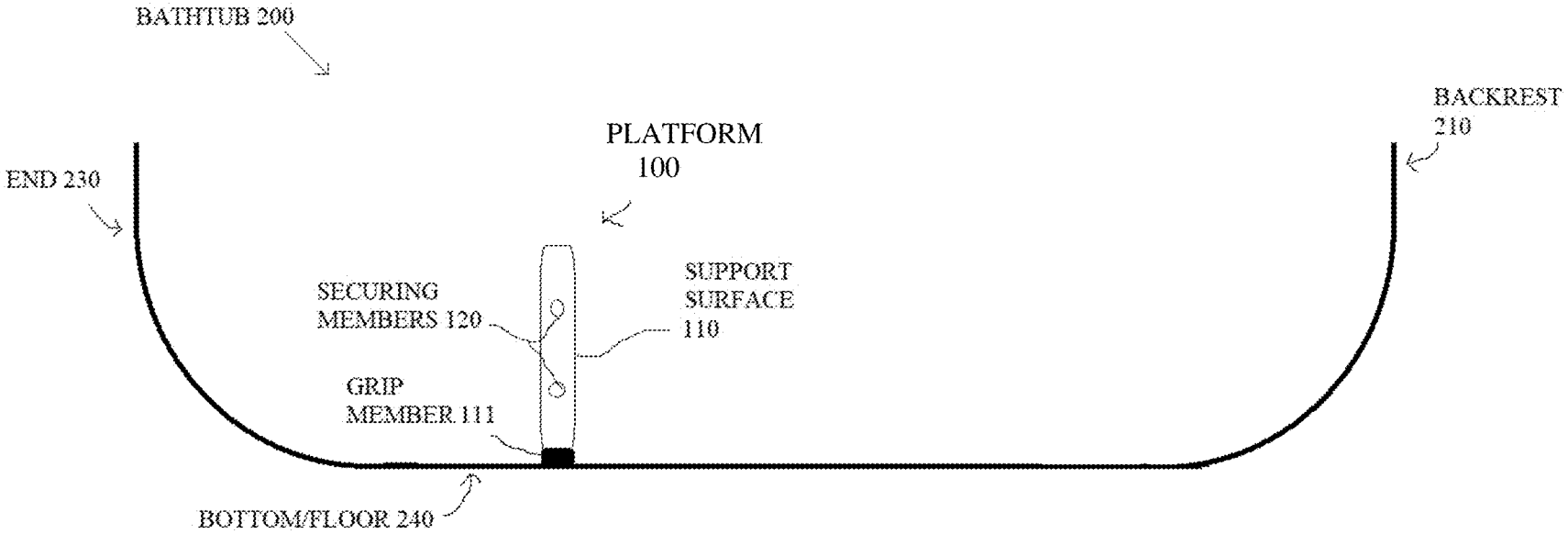
FIG. 3 illustrates an example the bottom of the bathtub platform insert resting on the bottom of the bathtub in accordance with one or more embodiments of the present disclosure.

In addition, in one embodiment as shown in FIG. 3, the bottom of the platform 100 is meant to rest on the floor/bottom 240 of the bathtub 200. As such, a grip member 111, such as a rubber "foot" or suction cups may be added for additional non-slip support of the platform/footrest.

Figure 4A:
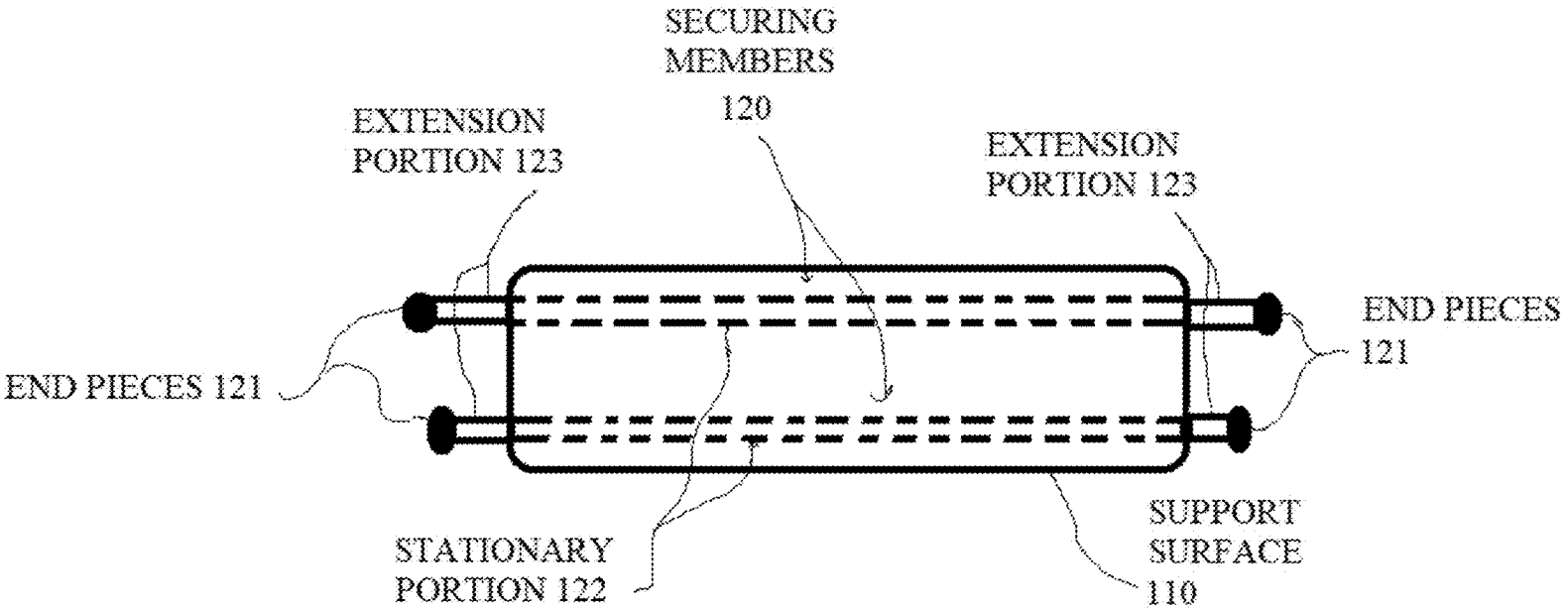
FIGS. 4A-4B illustrate an example of the general expandability of the securing members of the bathtub platform insert in accordance with one or more embodiments of the present disclosure.
Figure 4B:
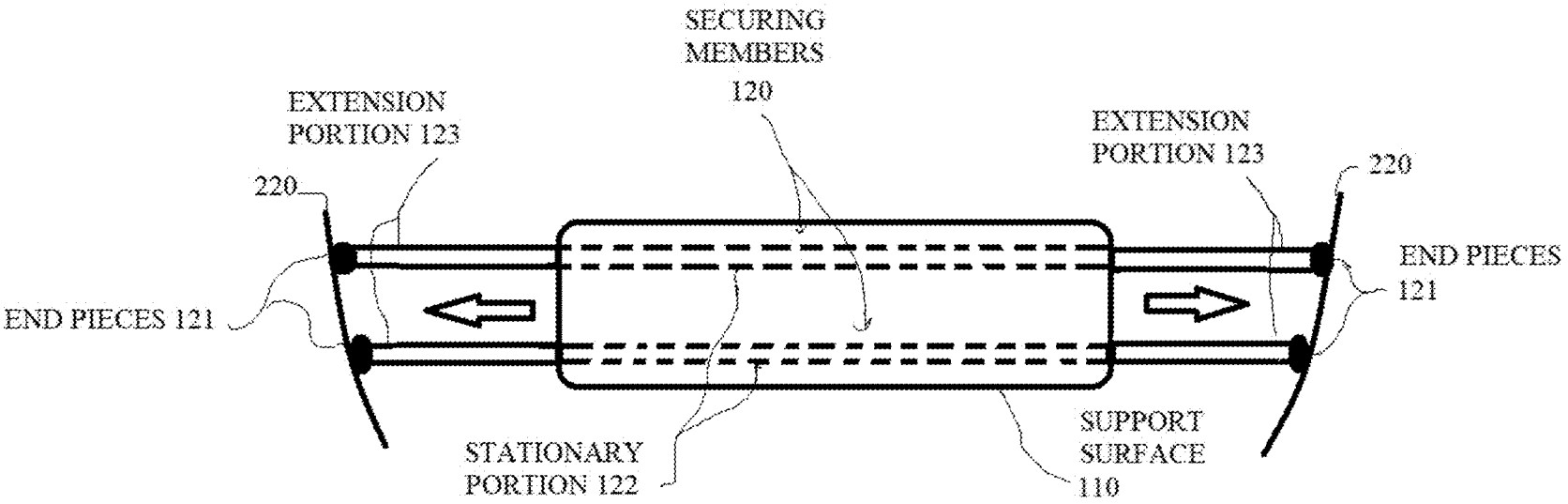

Referring now to the securing members 120, FIGS. 4A-4B illustrate the general expandability of the securing members 120, where FIG. 4A shows the securing members in a compressed/shortened state, and FIG. 4B shows the securing members in an expanded/lengthened state, allowing an end piece 121 located at the proximal end of one or more (e.g., each) of the securing members 120 to contact the interior side walls 220 of the bathtub 200. Note that end pieces 121 may comprise a type of cover with special "gripping" capabilities, such as rubber, suction cup technology (e.g., a static suction cup and/or a lever-assisted suction cup), or other designs that will keep the footrest in place, especially when weight or force is applied by the bather's feet/back/etc.

The securing members 120 may (e.g., each) comprise a stationary portion 122 affixed to the foot support surface 110, and an extension portion 123 that extends from (e.g., telescoping from) at least one end (or both ends) of the stationary portion. As such, the securing members may be adjusted (e.g., independently) to allow compressive contact of the "gripping end pieces" 121 (or merely the end of the securing member 120) to the bathtub walls, thereby securing the platform insert 100 in place in the bathtub 200. That is, the securing members 120 may be adjusted to different widths for different sized bathtubs or different placements/locations within the tubs (e.g., higher away from a floor 240 of the bathtub 200, lower to the floor, further away from a backrest 210 of the bathtub, closer to the backrest, etc.).

Note that while the examples shown above have a single stationary portion 122 passing from one side of the platform to the other, certain other embodiments may be designed such that the securing members do not pass from one side of the bathtub to the other, but may only protrude from one respective side of the footrest. For example, in one embodiment, four securing members 120 may be used, with two on one side and two on the other, as opposed to two securing members that pass through to both sides. In another embodiment, a single securing member 120 may be used on each side of the platform 100, which may have one or more end pieces 121 extending therefrom. Also, while securing members are shown with corresponding extension portions 123 on each side, alternative embodiments may simply have only stationary portions on one side, and extension portions on the other side (i.e., only one side adjusts, while the other remains stationary).

Figure 4C:
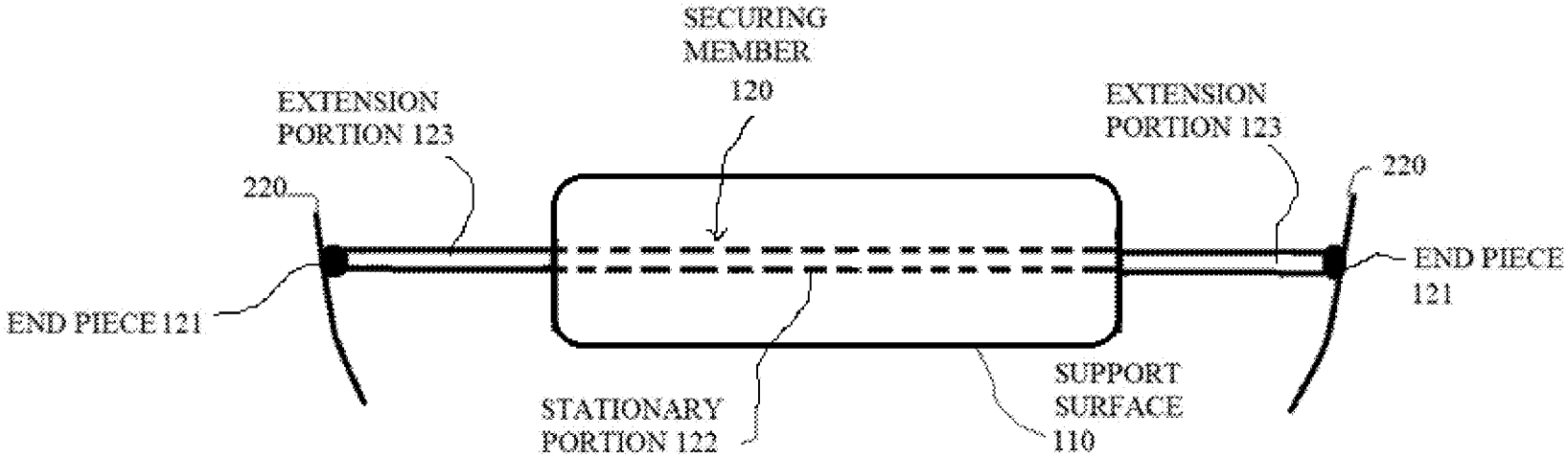
FIG. 4C illustrates an example of the general expandability of a single securing member of the bathtub platform insert in accordance with one or more embodiments of the present disclosure.

Preferably, there are two securing members to help prevent twisting of the secured footrest's angle, however, as noted, alternative embodiments may have only one securing member. For example, FIG. 4C illustrates an example where each side of the footrest 100 has only a single securing member 120 (e.g., a single stationary portion 122 and two opposed extending portions 123, accordingly). Still further embodiments may have more than two (e.g., three or more), and further embodiments may have more end pieces 121 at the end of the securing member(s) 120.

Figure 4D:
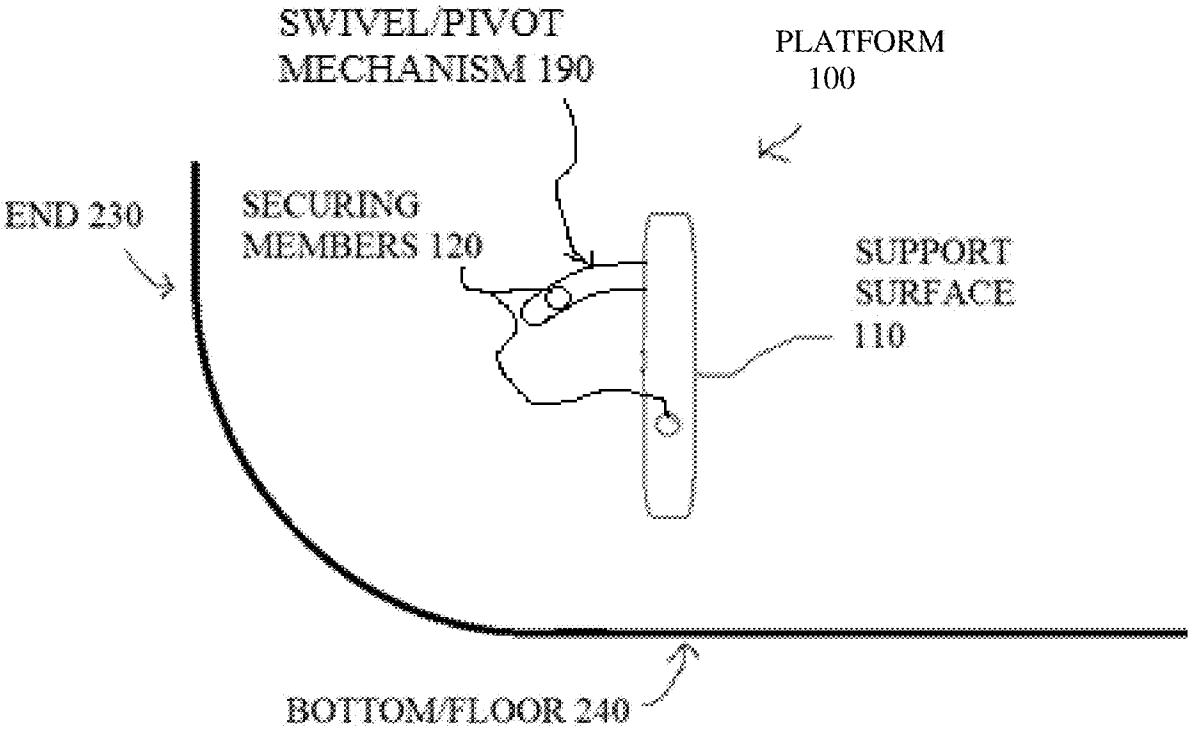
FIGS. 4D-4E illustrate examples of mechanisms for adjusting the angle of the support surface of the bathtub platform insert in accordance with one or more embodiments of the present disclosure.
Figure 4E:
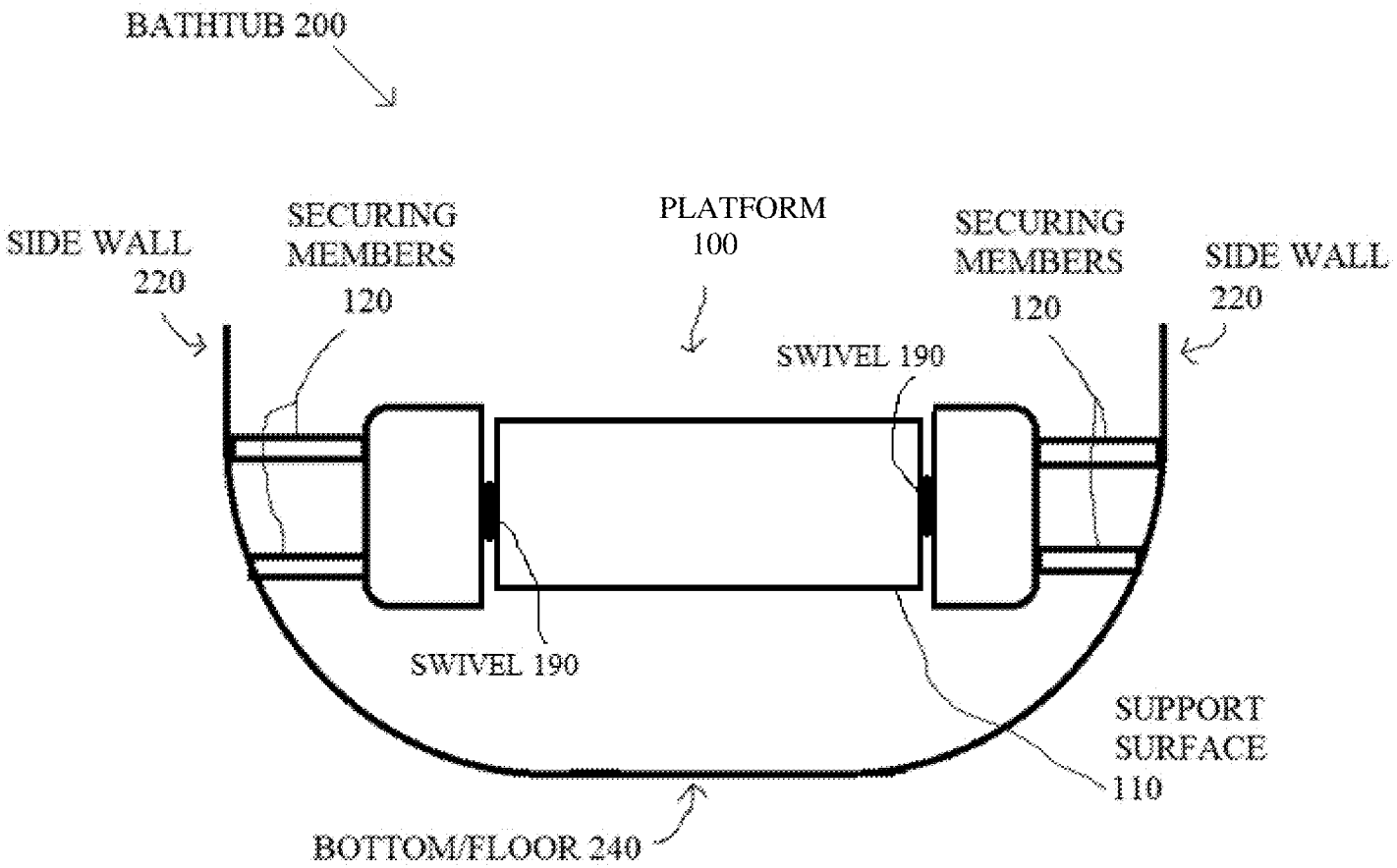

Moreover, an angle of the platform 100 (e.g., relative to the floor 240 of the bathtub 200) may also be adjusted per bather preference based on secured placement of the platform, allowing for any angle from perpendicular to the floor (straight up and down) to parallel to the floor (flat, e.g., possibly even being used as a bench or shelf for the bather's calves or bath-related items, generally). In one embodiment, by simply angling and securing the footrest at that angle, the footrest can be secured at any fixed angle desired while the bather bathes. In an additional embodiment, as shown in FIG. 4D, a swivel/hinge/pivot mechanism 190 may be located between the securing members 120 and the support surface 110 to allow the bather to adjust the angle while in the bath. Various swivel/hinge mechanisms may be used, such as pins, tension, slide tracks, set screws, and so on, and any such mechanisms may be used herein, even if not explicitly shown. Also, the location of the swivel/hinge 190 may be any suitable location, including on the rear of the support surface 110, the sides of the support surface, etc. Also, while the entire foot support surface 110 is shown as pivoting, portions of the support surface may adjust angle separately from the rest of the surface, such as the center rotating separately on pivots 190 from the ends, as shown in FIG. 4E.

Figure 5A:
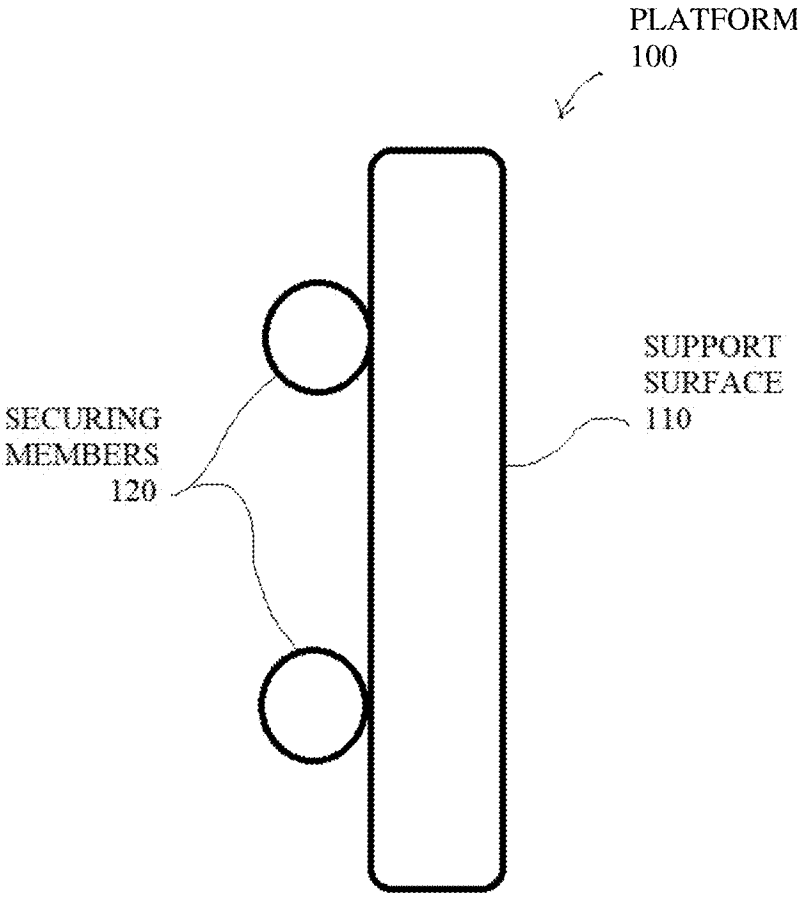
FIGS. 5A-5B illustrate an example of the securing members being affixed to a "rear" of the bathtub platform insert in accordance with one or more embodiments of the present disclosure.
Figure 5B:
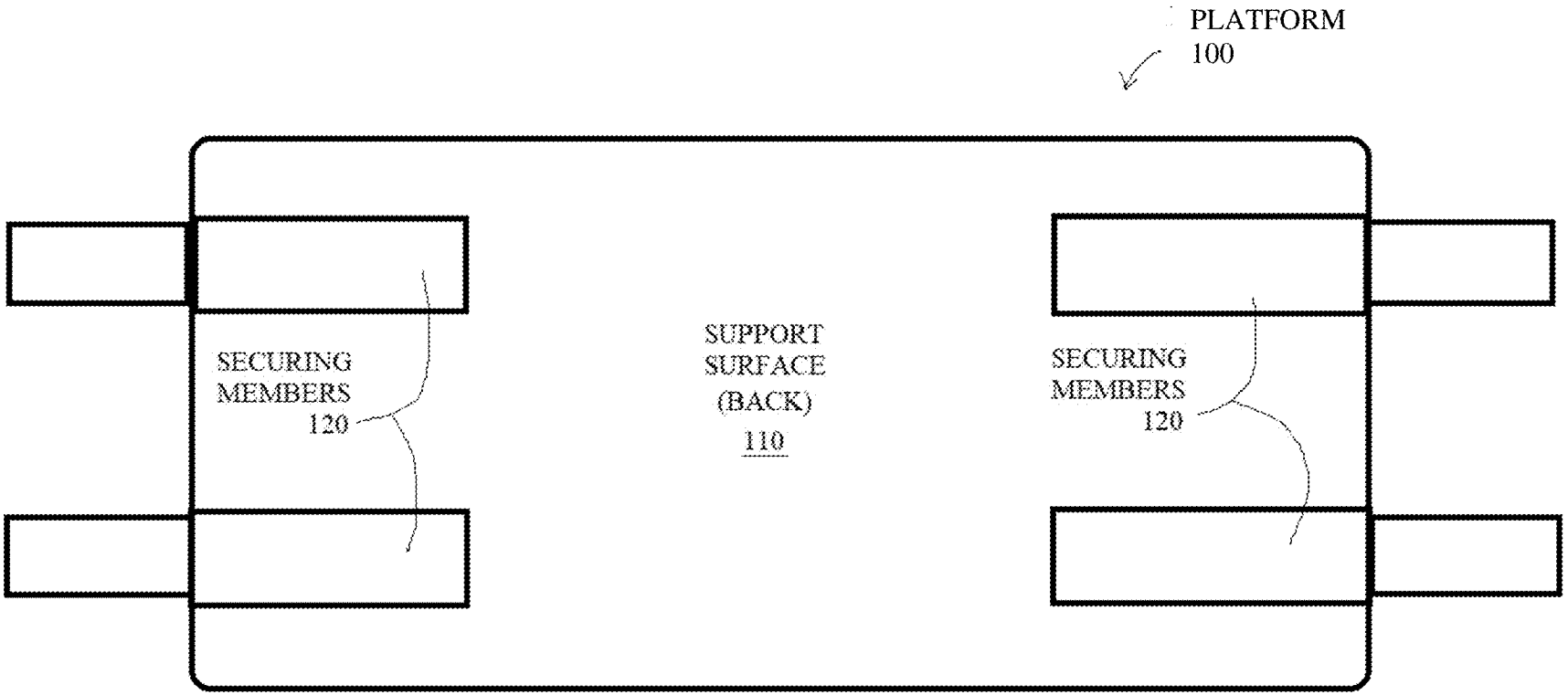

In one embodiment, as shown above, the securing members 120 may protrude from within the foot support surface 110, passing through holes therein. In an alternative embodiment, as shown in FIG. 5A, the securing members may be affixed to the "rear" face of the support surface (i.e., the side facing away from the bather's feet) through brackets, bolts, welding, molding, adhesives, etc. Note further that the stationary portion 122 of the securing members 120 may actually be a component of the support surface 110 (e.g., molded openings, tubes, or other integrated components). Also, FIG. 5B illustrates one example of the embodiment mentioned above, where the securing members 120 protrude independently from only one side of the platform 100, as opposed to being a single component from one side to the other, as in FIG. 5A.

Figure 6A:
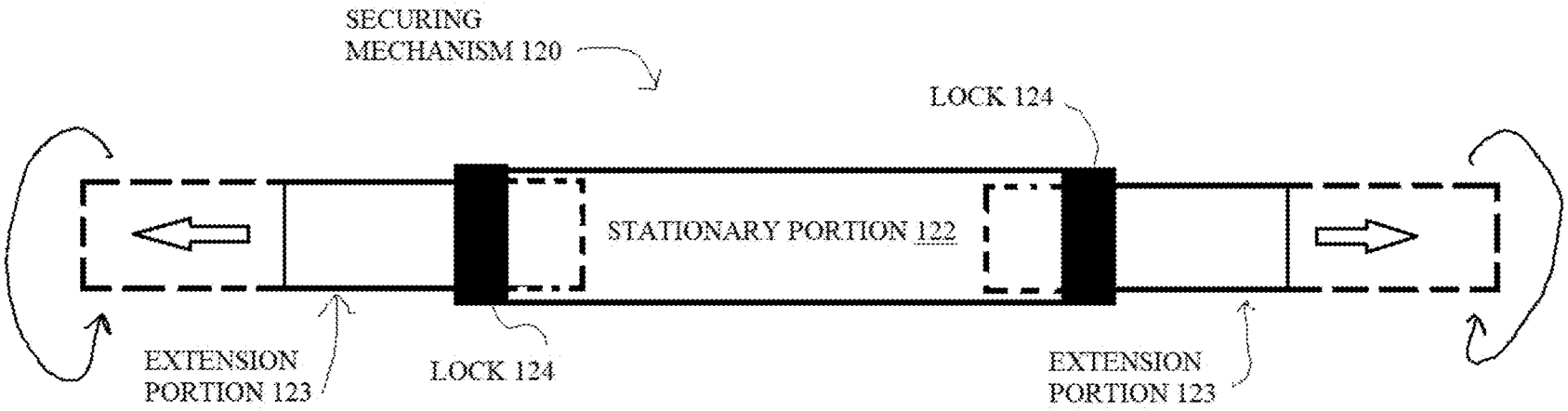
FIGS. 6A-6F illustrate an example of expansion options of securing members of the bathtub platform insert in accordance with one or more embodiments of the present disclosure.
Figure 6B:
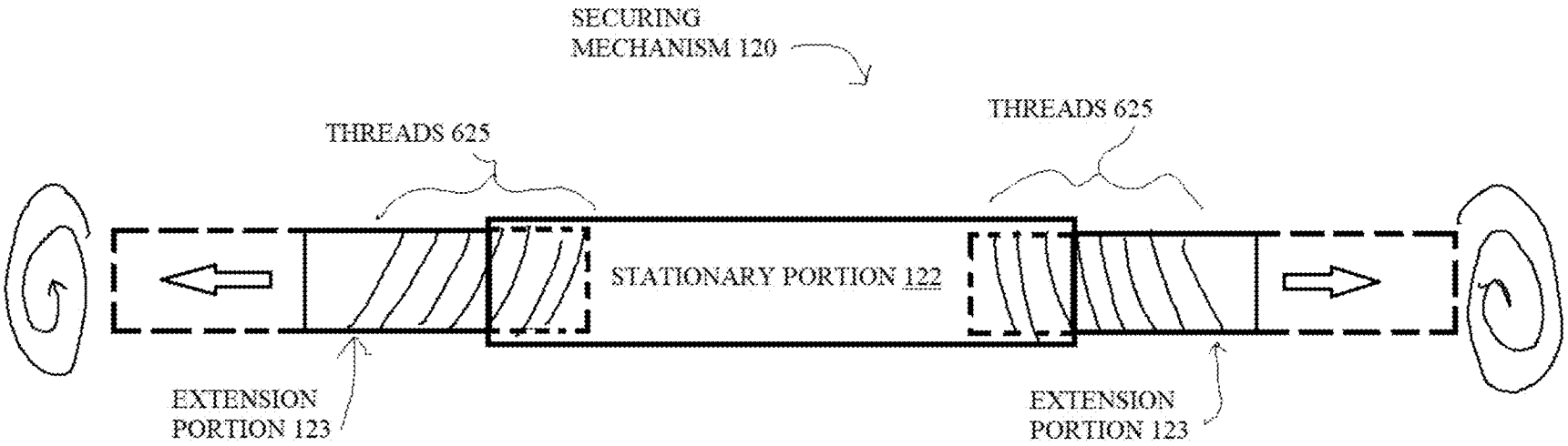
Figure 6C:
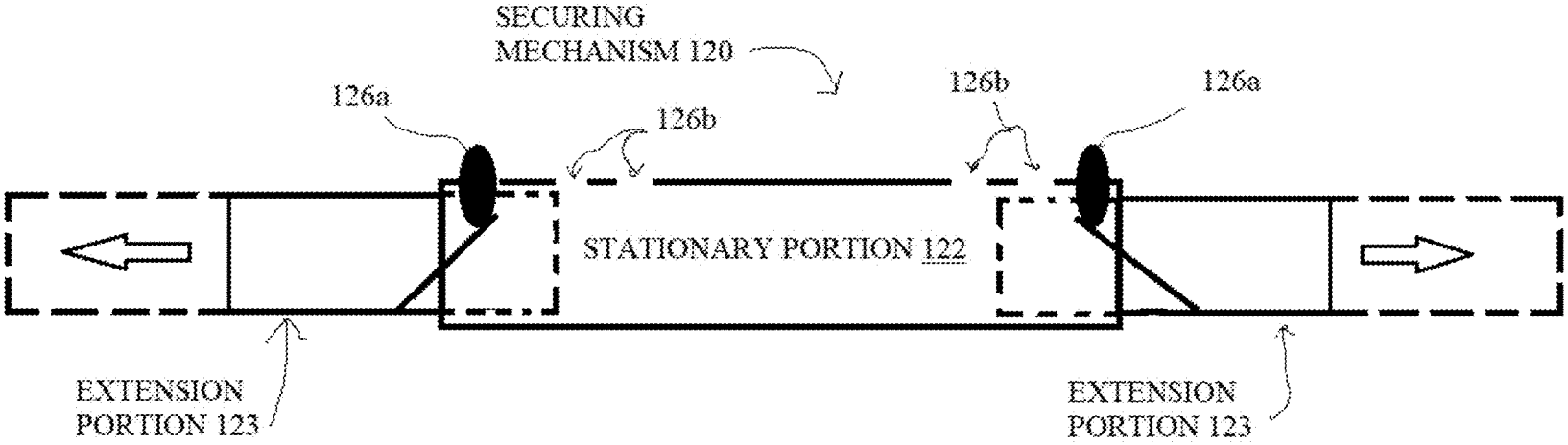

FIGS. 6A-6F illustrate greater detail of example expansion options of securing members 120. For instance, as shown in FIG. 6A, the securing members 120 may comprise tension rods, which may have an internal spring (not shown) to spring load the tension, or else (or additionally) may have a lock/unlock (locking) mechanism 124 between the stationary portion 122 and extension portion 123, which may be engaged or disengaged after adjusting the length of the securing member, accordingly. For instance, in one embodiment, the locking mechanism 124 may comprise a telescoping twist lock clamp, which locks and unlocks by twisting the extension portion 123 in a corresponding direction. Alternatively, the locking mechanism 124 may comprise a clamp with a flip lever or other mechanism to apply force to lock the extension portion 123 in place. In still another embodiment, in FIG. 6B, a threading mechanism 125 may be used to allow the extension portions 123 to telescope from the stationary portion 122, essentially unscrewing the extension portions 123 from within the stationary portion 122. In a further embodiment, as shown in FIG. 6C, button/spring clips 126*a* and apertures 126*b* may be used, as may be appreciated by those skilled in the art.

Figure 6D:
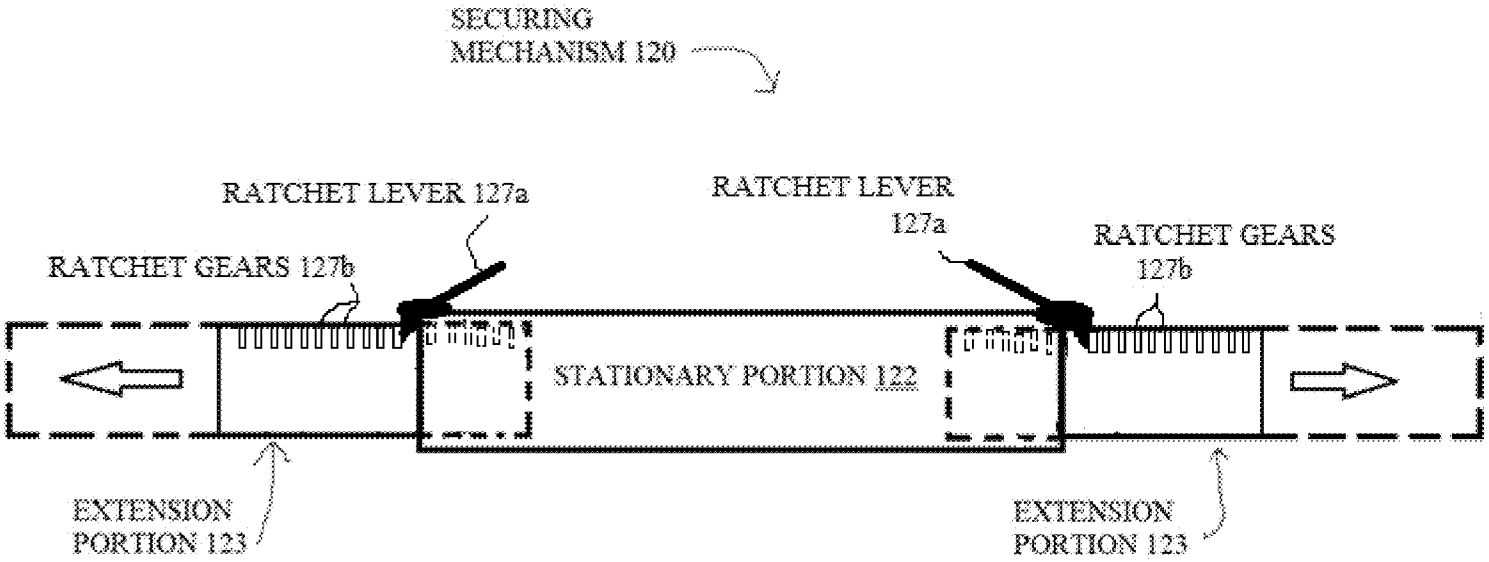
Figure 6E:
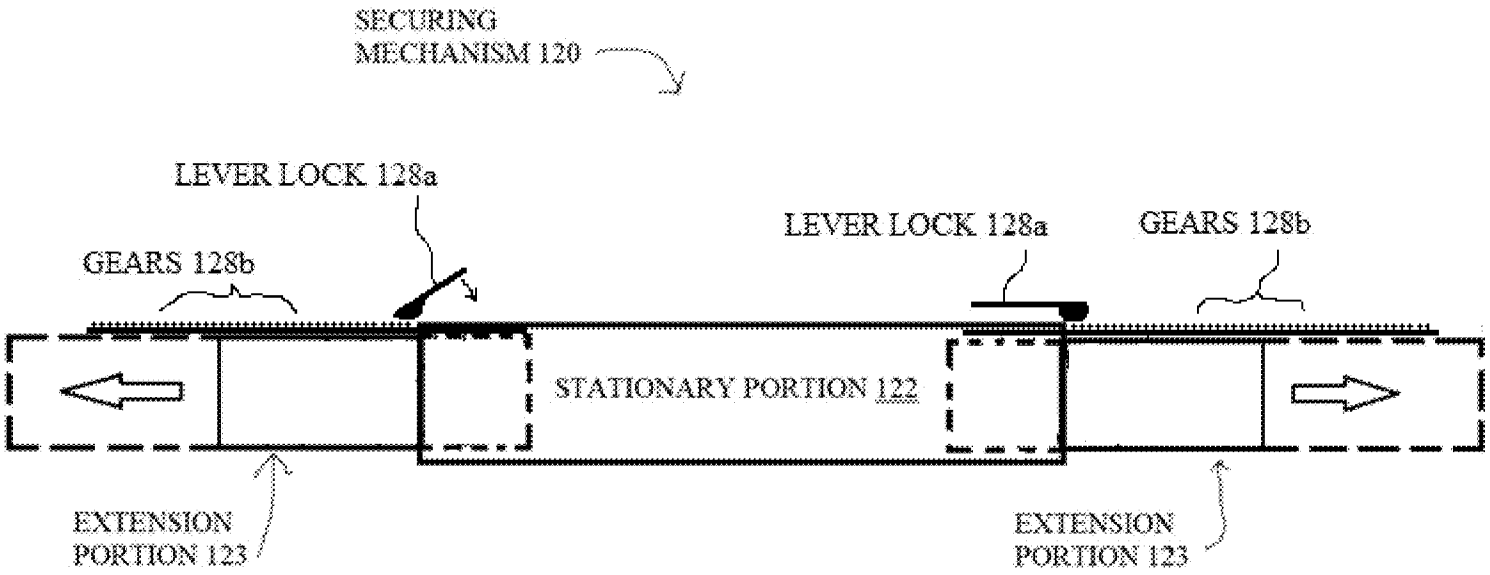
Figure 6F:
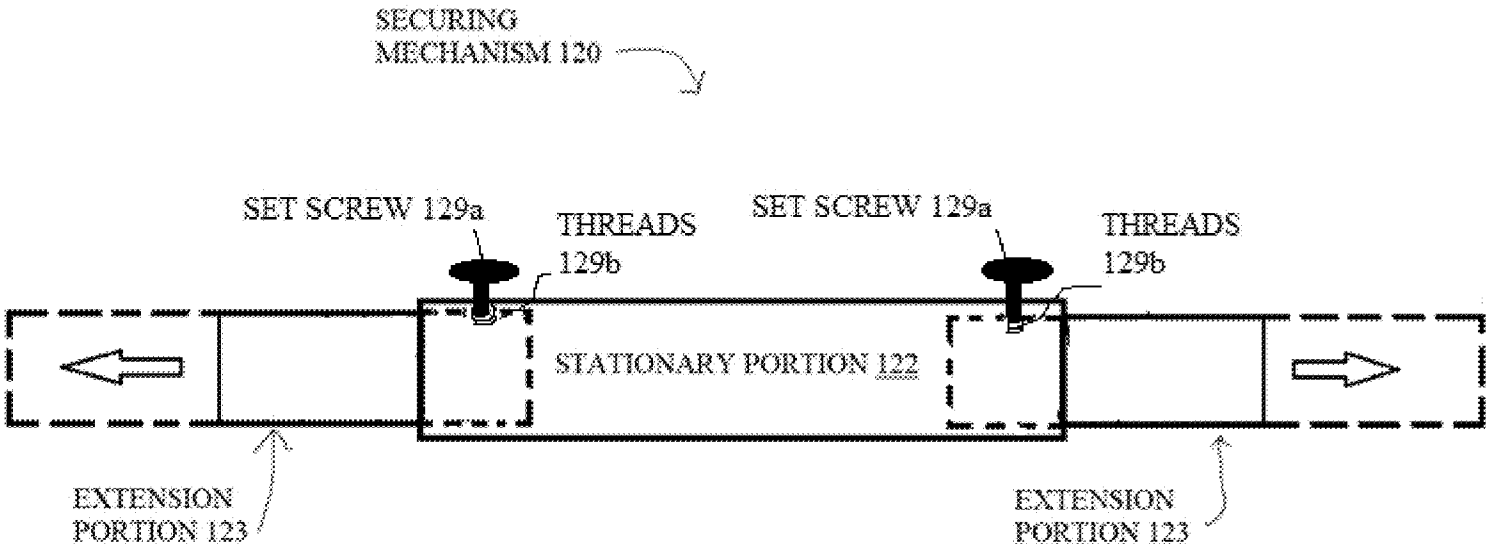

Still further, in FIG. 6D a ratcheting bar may be used, with a ratchet lever 127*a* engaging ratchet gears 127*b* in the extension portion 123 (or vice versa), allowing the extension portion to be extended in one direction only, until the ratchet lever 127*a* is released. Also, as shown in FIG. 6E, a lever lock 128*a* may engage a channel of gears 128*b* on the extension portion 123 (or vice versa), such that the lever lock in a released position allows free movement of the extension portion, and closing the lever lock 128*a* engages the gears 128*b* and further presses the extension portion outwardly toward the side walls 220 of the bathtub to provide greater securing force until locking in place (until the lever lock is again released). As yet another embodiment, as shown in FIG. 6F, various set screws 129*a* may pass through a threaded aperture 129*b* of the stationary portion 122 to tighten against the extension portion 123 at the desired position.

Notably, any number of expansion and securing techniques may be used, including using different methods for different extension portions, and those shown herein are non-limiting examples. For example, in certain embodiments, such as those with suction cups or hanging hooks, the securing members need not secure in place, as compression is not used (or is at least not necessary) to hold the platform in place. Also, as mentioned above, although securing members in FIGS. 5A-6F show both sides with extension portions 123, the embodiments herein may have a stationary portion on one side and an extension portion on the other side (i.e., only a single side with an extension portion, where one side of the stationary portion directly contacts the tub wall, and the corresponding extension portion contacts the opposing tub wall, accordingly).

Figure 7:
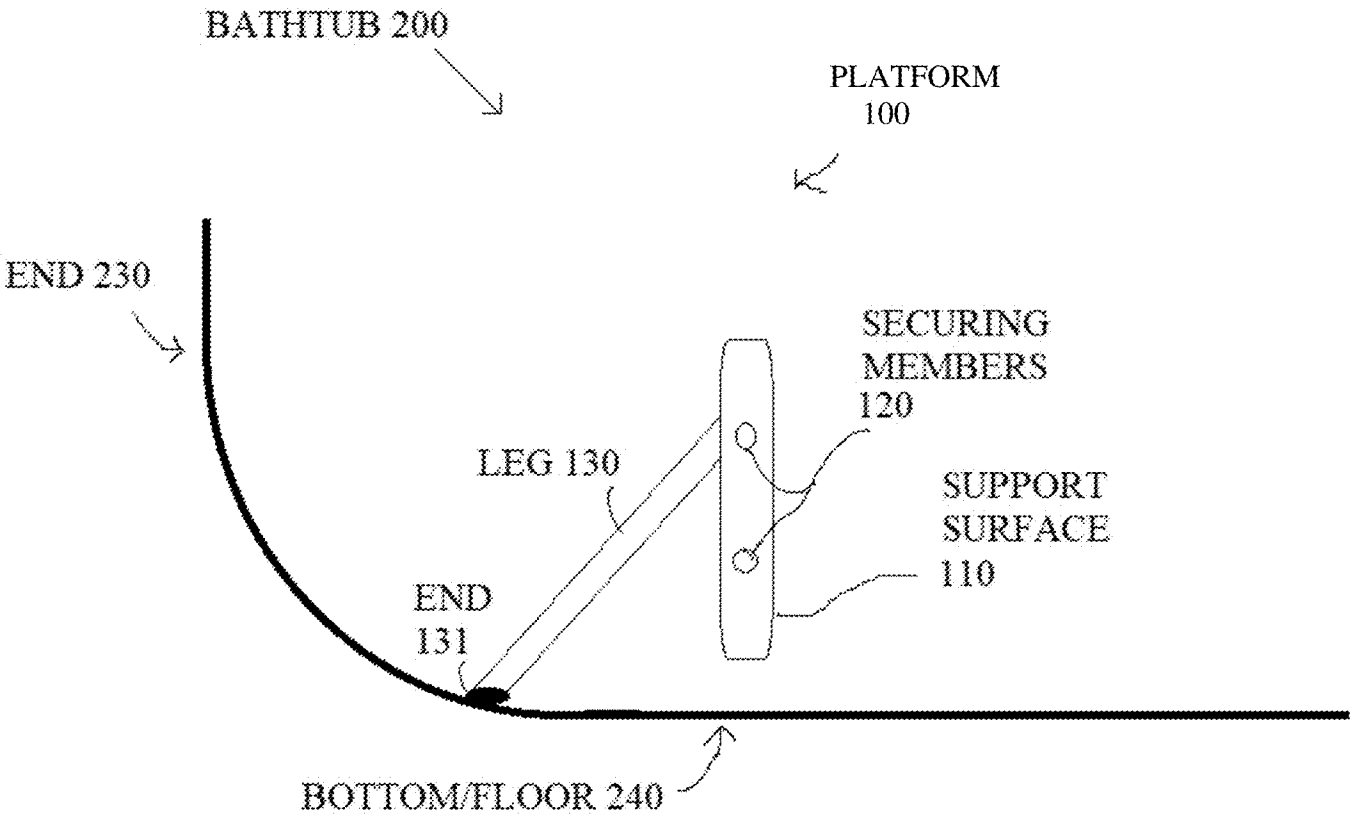
FIG. 7 illustrates an example of support legs extending from the top of the bathtub platform insert in accordance with one or more embodiments of the present disclosure.
Figure 8:
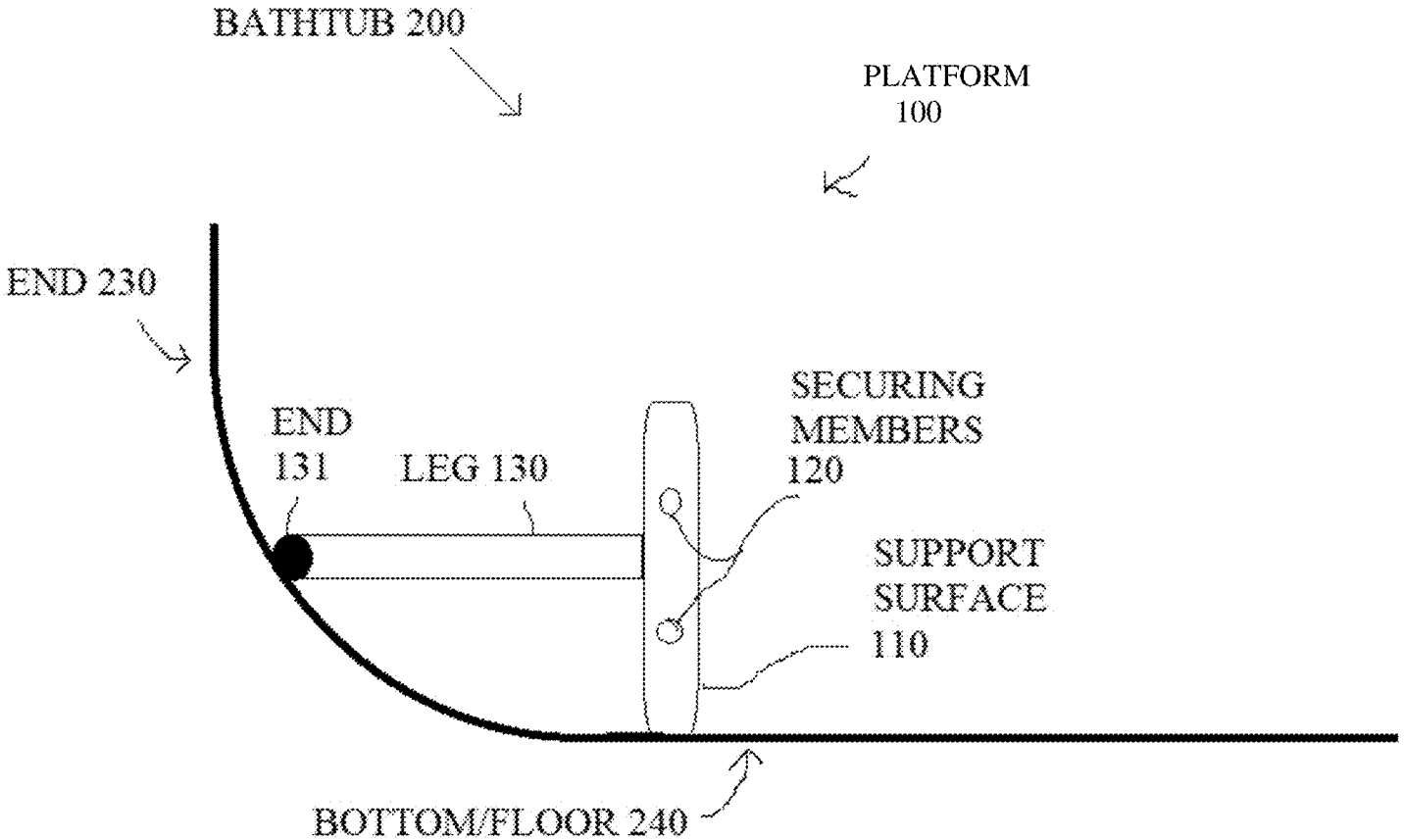
FIG. 8 illustrates an example of support legs extending from the back of the bathtub platform insert in accordance with one or more embodiments of the present disclosure.
Figure 9:
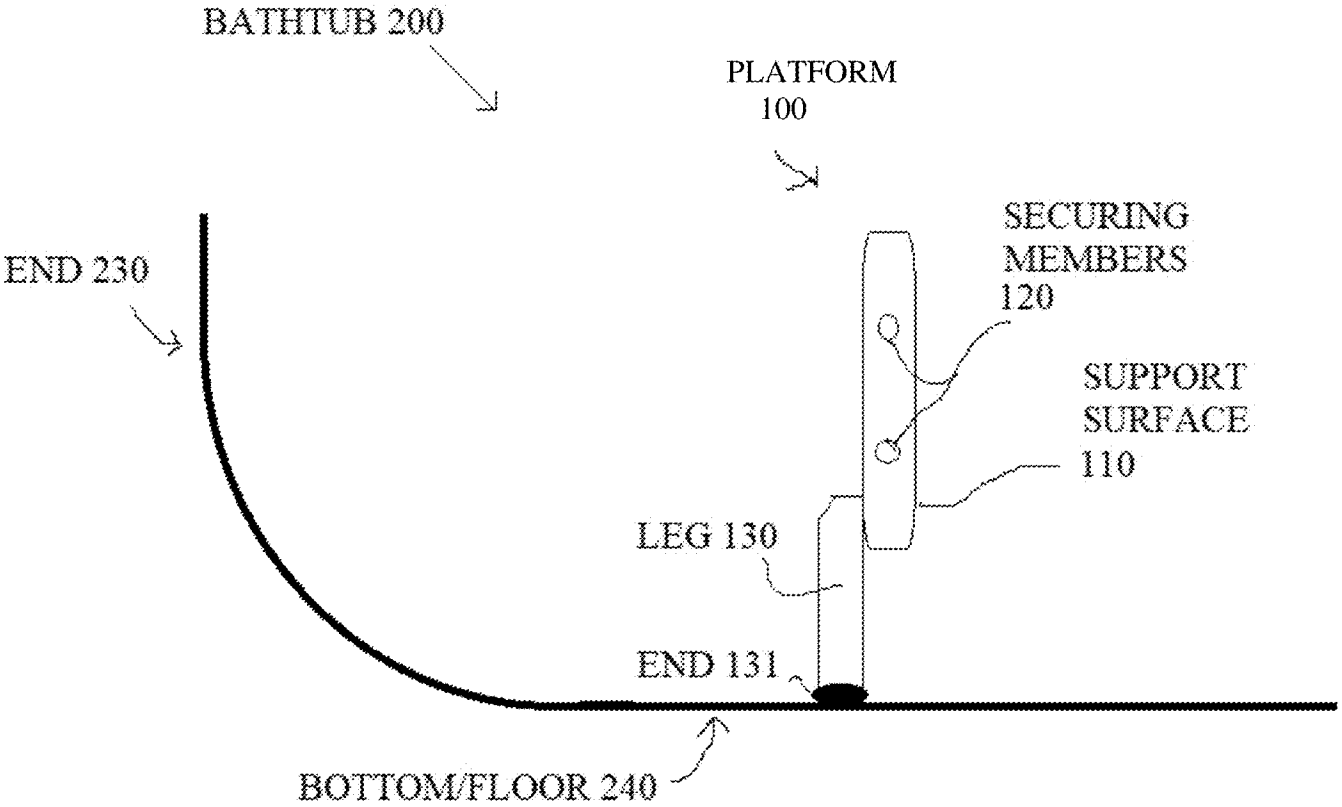
FIG. 9 illustrates an example of support leg extending downwardly from the bathtub platform insert in accordance with one or more embodiments of the present disclosure.

According to additional embodiments of the present disclosure, one or more additional support legs may be configured behind the footrest to further support the weight/pressure of the bather (e.g., bather's feet, back, legs, bath objects, etc.). For instance, as shown in FIG. 7, one or more support legs 130 may extend from the top of the platform 100 (e.g., from the back of foot support surface 110) to the bottom 240 of the bathtub 200. The base of the leg(s) 130 may have an end piece 131 such as a suction cup or rubber cap that helps to hold the leg(s) in place. Alternatively, FIG. 8 illustrates an example where the one or more legs 130 extends from the back of the footrest 100 that will rest against the end 230 of the bathtub, and may also have an end piece 131 to hold the leg(s) in place. As shown in FIG. 9, the leg(s) 130 may extend downwardly from the bottom of the footrest to the bottom 240 of the bathtub in order to prevent the footrest from sliding/falling down from a set height. Notably, in each of FIGS. 7-9, the support leg(s) 130 may be adjustable in a manner similar to those described above for the support members 120 above (e.g., telescoping, extending, locking, and so on).

Figure 10:
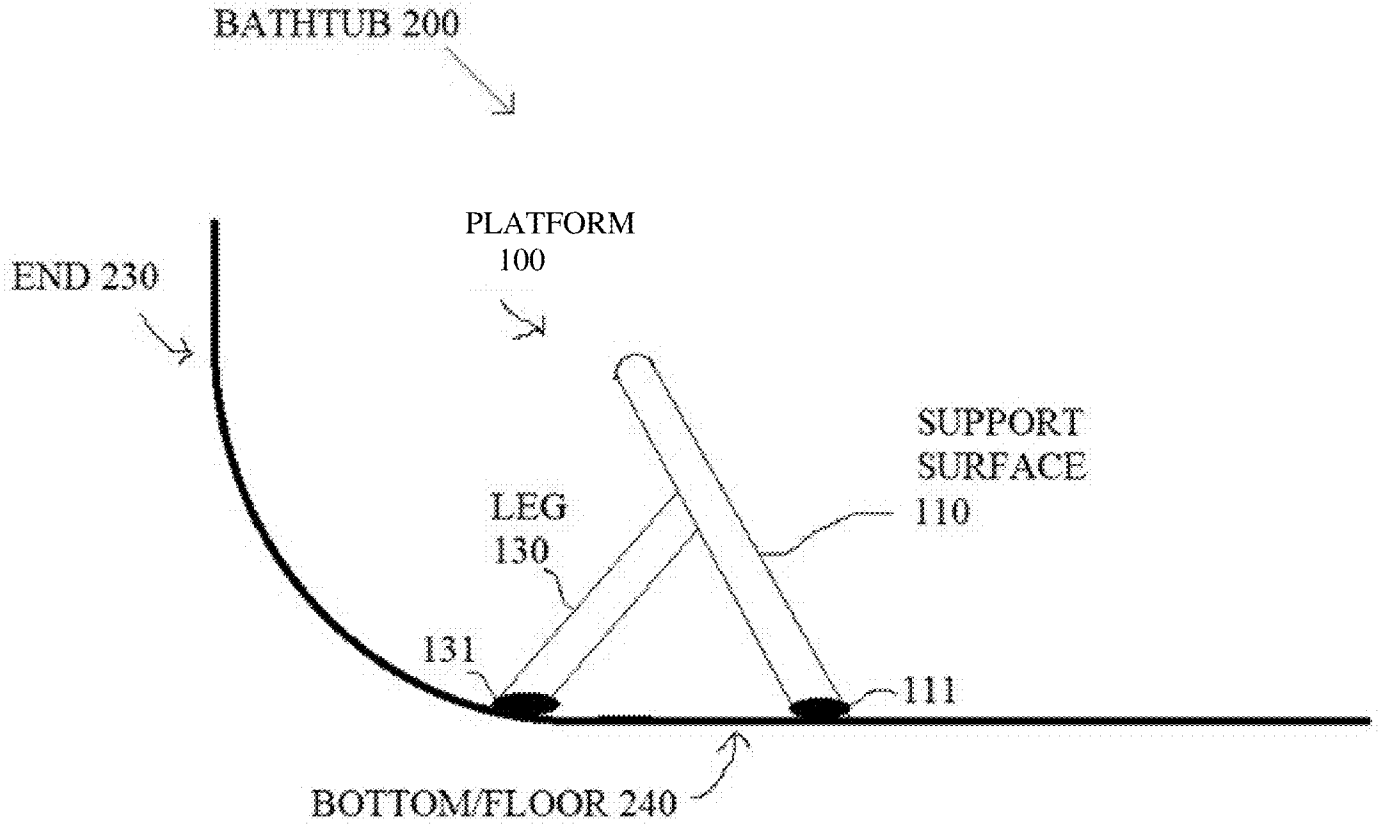
FIG. 10 illustrates an example of a free-standing bathtub platform insert in accordance with one or more embodiments of the present disclosure.

In an alternative embodiment of the present disclosure, as shown in FIG. 10, the bathtub platform insert 100 may be generally free-standing, where the bathtub platform (footrest) insert 100, particularly the support surface 110, rests directly on the bottom 240 of the bathtub 200, and has one or more securing/support members (e.g., legs 130) extending from the rear of the platform/footrest to support it against pressure from the feet of the bather. That is, in this specific embodiment, there is nothing that attaches the platform/footrest to the sides 220 of the tub (i.e., no support members 120 extending from the sides of the support surface 110). In this embodiment, the leg(s) 130 and/or the bottom of the support surface 110 may have has suction cups or other gripping mechanisms (e.g., leg ends 131 and/or foot support surface grip member 111).

Figure 11:
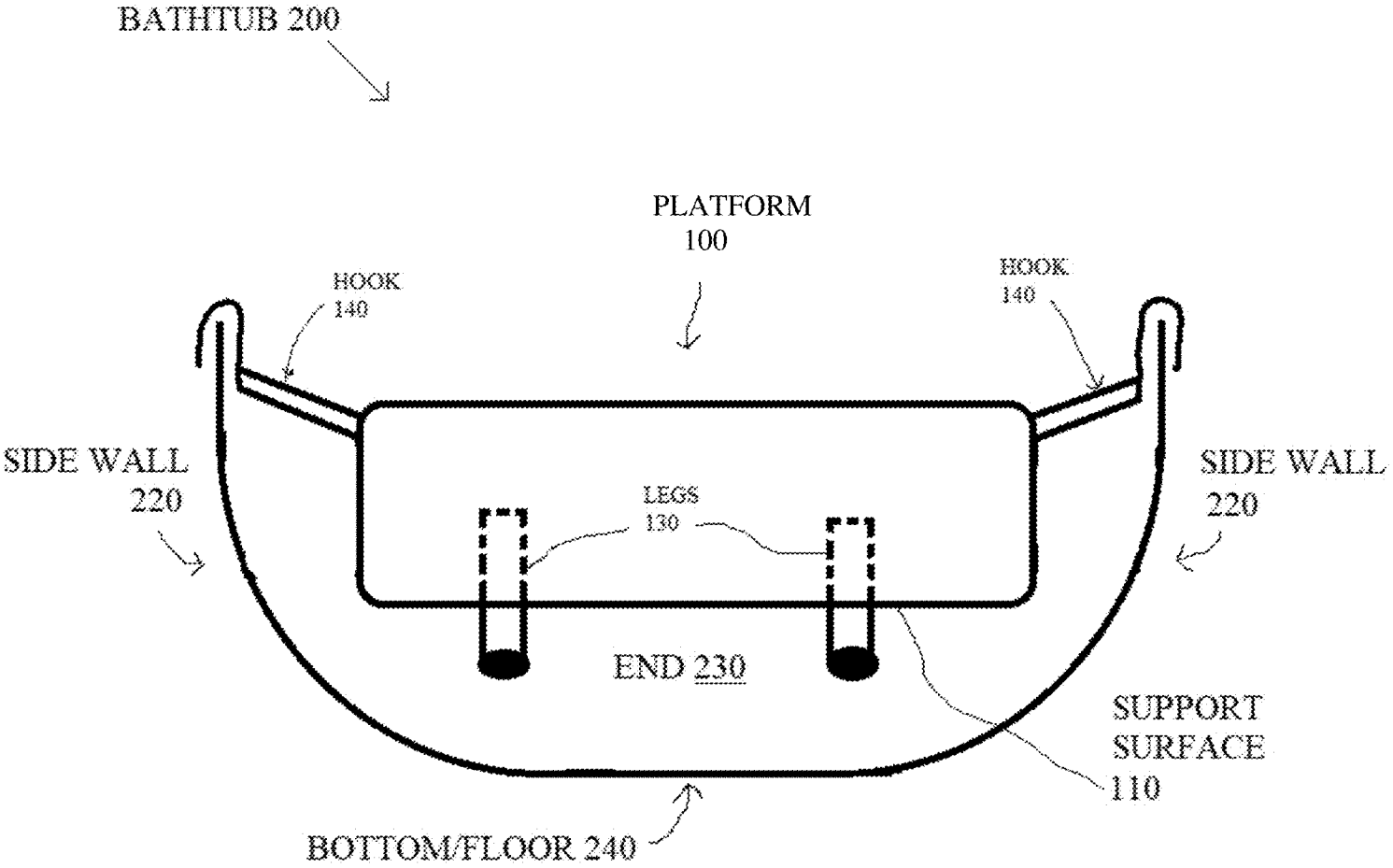
FIG. 11 illustrates an example of the bathtub platform insert hanging from the sides of a bathtub in accordance with one or more embodiments of the present disclosure.

In another alternative embodiment of the present disclosure, as shown in FIG. 11, the bathtub platform insert 100 may hang from the sides 220 of the bathtub, where the bathtub platform insert 100 hangs above the bottom 240 of the bathtub 200 using opposing hooks 140 on either side of the platform to support it against gravity. In this specific embodiment, leg(s) 130 may still be used to press against the end 230 of the bathtub 200 to prevent the platform (e.g., particularly as a footrest or backrest) from being pushed away from the bather.

Figure 12:
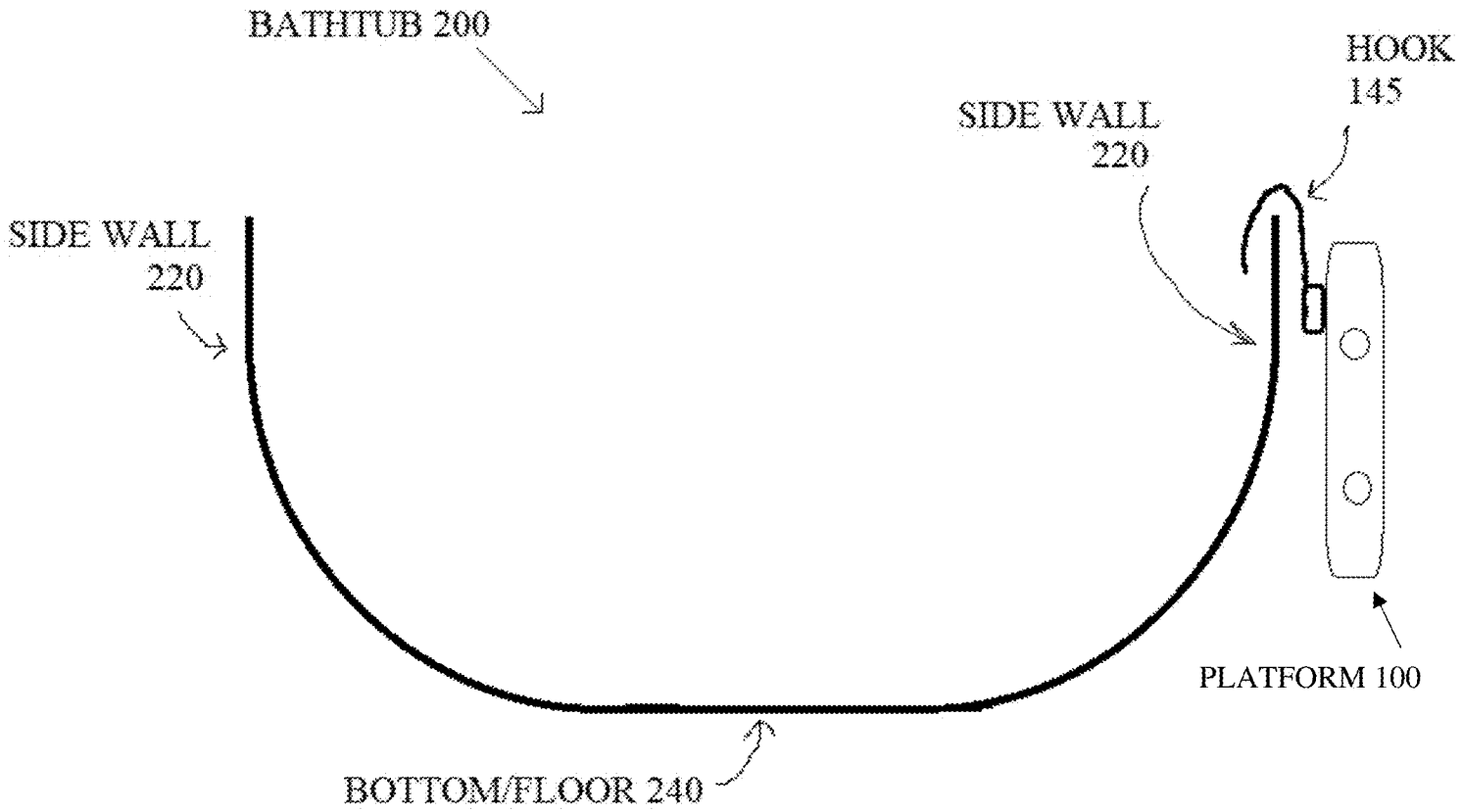
FIG. 12 illustrates an example of a hook to hang the bathtub platform insert for storage in accordance with one or more embodiments of the present disclosure.

FIG. 12 illustrates one embodiment of the platform 100 where a hook 145 may be located on the back of the platform for hanging the platform for storage (e.g., on the inside or outside of the bathtub 200, such as on side walls 220 as shown, or else over a door, shelf, towel rack, or other supports).

Figure 13A:
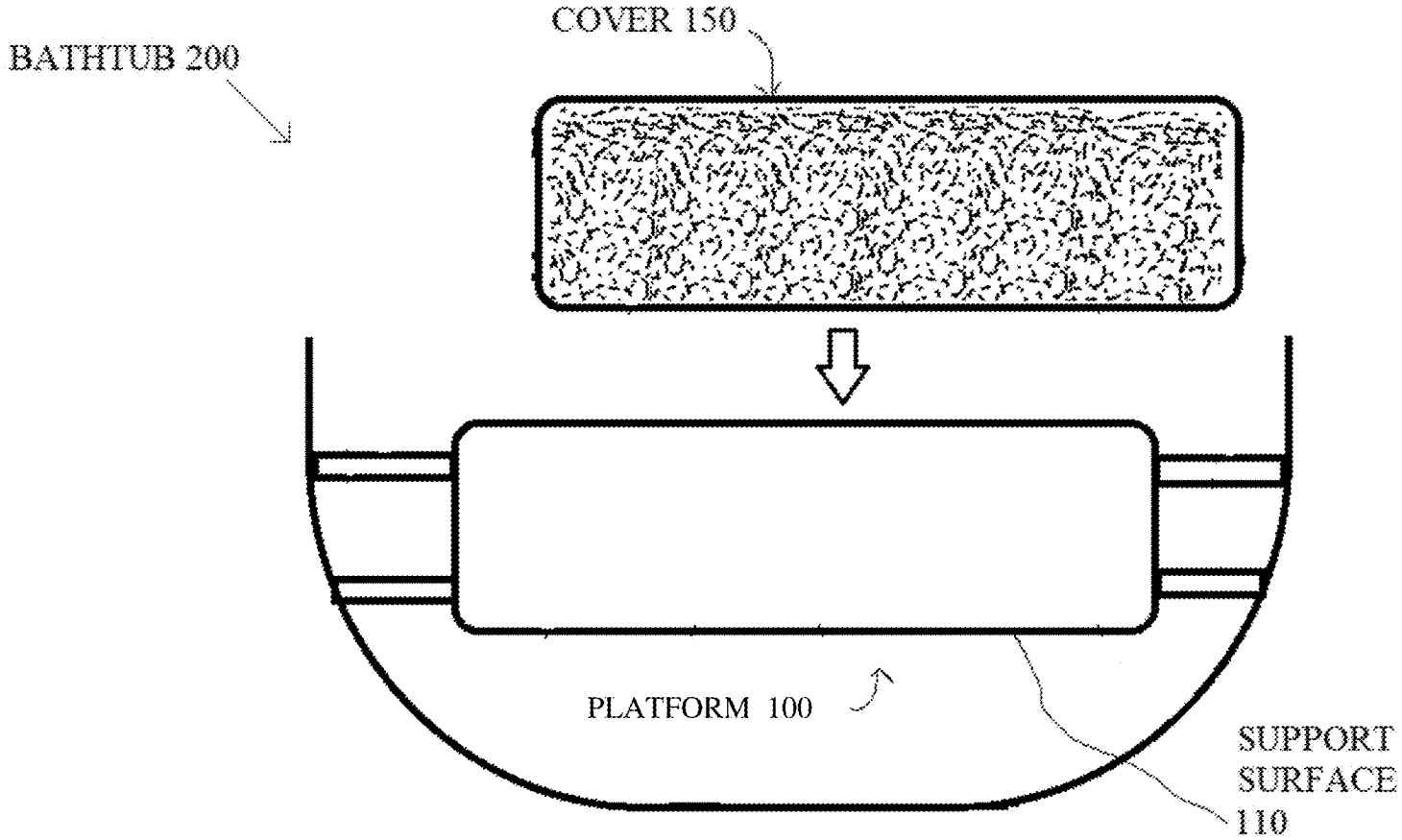
FIGS. 13A-13B illustrate an example of a replaceable or exchangeable covering over the bathtub platform insert in accordance with one or more embodiments of the present disclosure.
Figure 13B:
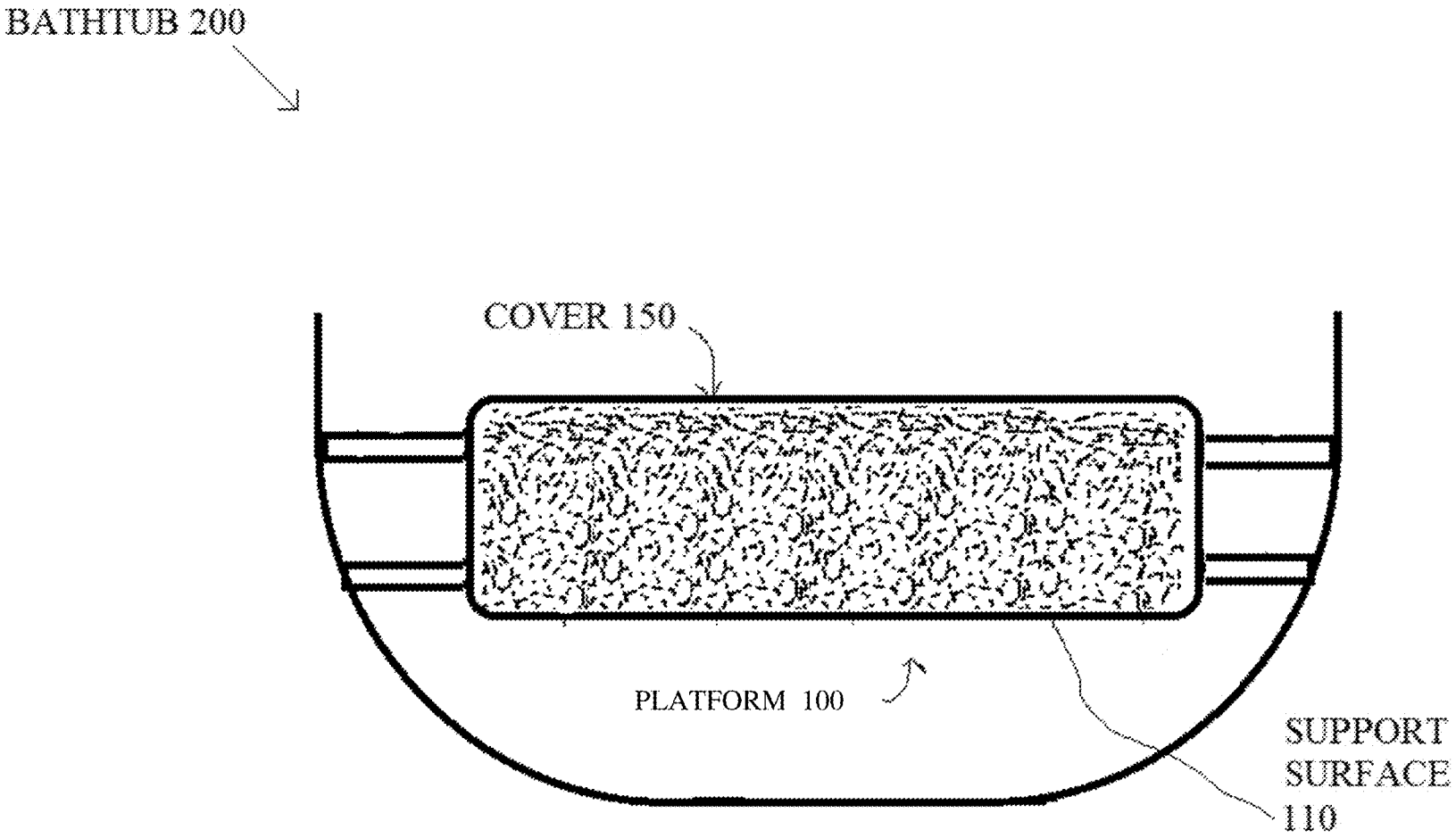

In still another embodiment, FIGS. 13A-13B illustrate how a cover 150 may be used to provide a replaceable or exchangeable covering over the platform 100, namely over at least support surface 110, to allow for different textures, materials, appearances, and so on. For instance, materials may be terrycloth, microfiber, sponge, foam, gel pads, plastics, abrasives, pumice stone, etc., and may provide for a soft/plush feel, passive massaging, cleansing action, scrubbing action, and so on. In this manner, a bather may further customize his/her bathing experience with tailored platform/footrest design by selecting from a desired cover 150. Also, for hotels or spas that use the footrest, the ability to interchange the cover 150 between users is essential for cleanliness and sanitation.

Figure 14:
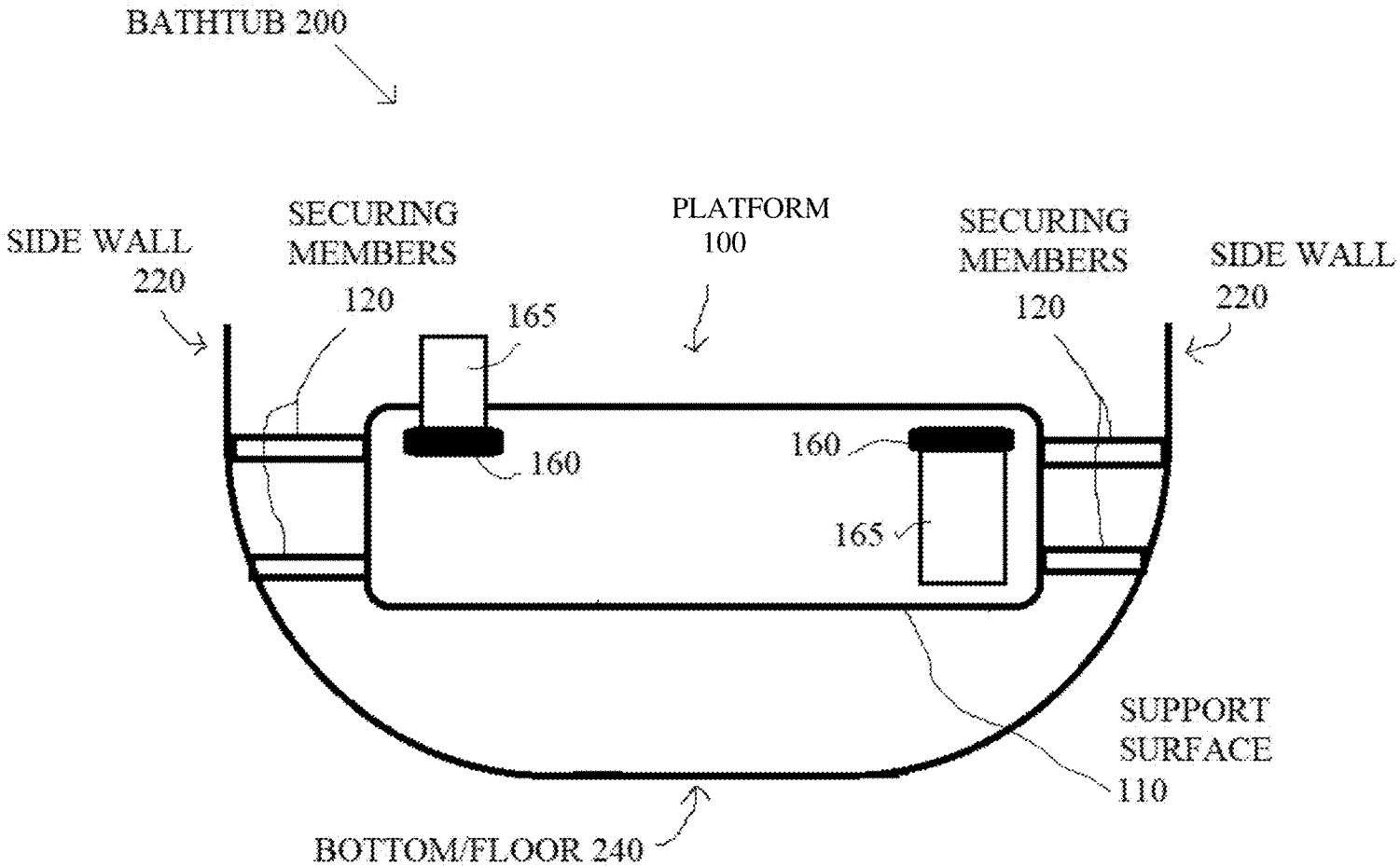
FIG. 14 illustrates an example of provisions for one or more accessories to be added to the bathtub platform insert in accordance with one or more embodiments of the present disclosure.

The bathtub platform insert 100 herein may also have provisions for one or more accessories to be added to the footrest. For example, as shown in FIG. 14, one or more accessory mounts 160 (e.g., apertures, clamps, threaded screw receptacles, etc.) may be configured to support one or more accessories 165. Example accessories may include such things as phone mounts, cup holders, wine glass holders, candle bases/holders, waterproof wireless speakers, pouches/containers to hold and diffuse bath bombs, bath salts, bath soaps, bath oils, and other bath products or storage containers, and so on. Notably, any of these and other accessories may also be built into the design of the platform 100, and need not be removable or customizable. Also, the location shown of the accessory mounts 160 and accessories 165 are merely examples, and any suitable location may be used in accordance with the embodiments herein.

Figure 15:
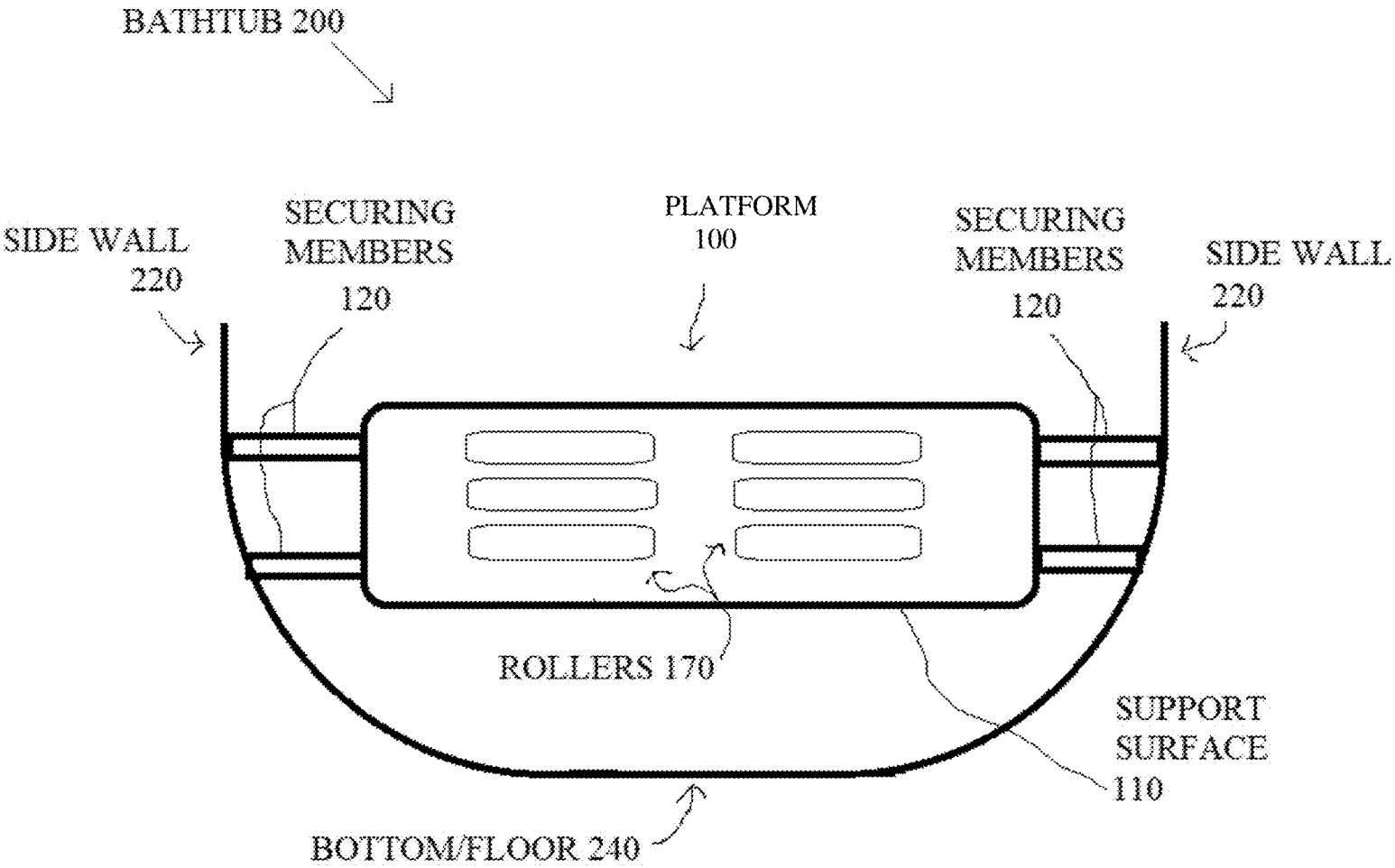
FIG. 15 illustrates an example of rollers on the bathtub platform insert in accordance with one or more embodiments of the present disclosure.

In one or more embodiment herein, as illustrated in FIG. 15, the support surface 110 may comprise one or more rollers 170 for a bather to press their feet (or back) against to receive a massaging pressure on their body. As shown, the rollers are generally cylindrical, but other shapes (e.g., oval, spherical, polygonal, and so on) may also be used. The number and location of the rollers 170 may also vary depending on design (e.g., a single large roller, a plurality of smaller rollers, a single section of rollers for both feet, a single section of rollers for one foot at a time, a pair of sections of rollers for both feet (as shown), different types/sizes for use with a back, and so on).

Figure 16:
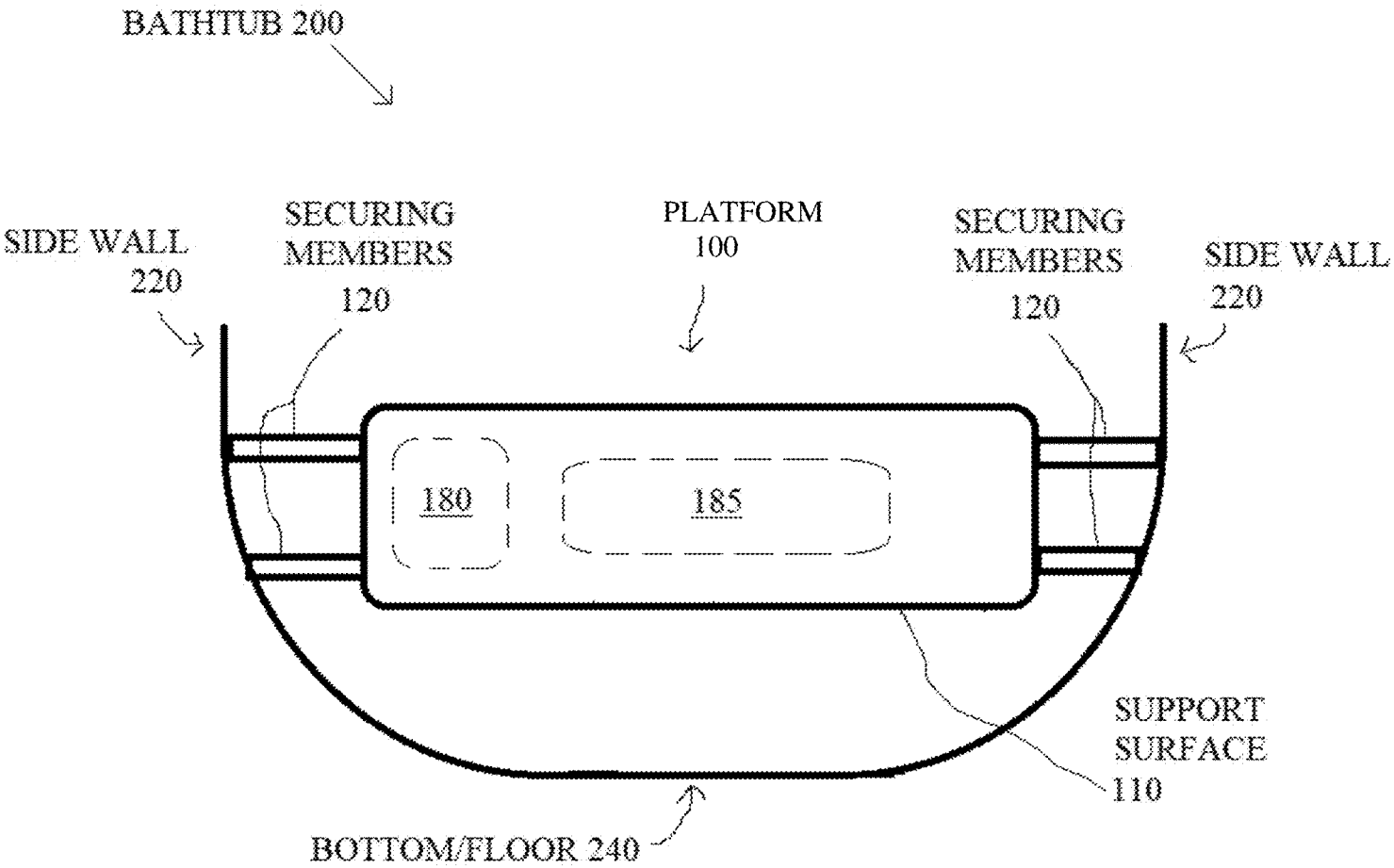
FIG. 16 illustrates an example of a waterproof battery compartment and battery-operated component for the bathtub platform insert in accordance with one or more embodiments of the present disclosure.

In still further embodiments, as shown in FIG. 16, a waterproof battery compartment 180 may be included with the platform 100 (e.g., as a built-in accessory or as an add-on accessory, as mentioned above). In these embodiments, various battery-operated mechanics 185 may be added to the footrest, such as massaging/vibrating motors, lights, heating elements, bubble makers/aerators, and so on. For instance, in one embodiment, a battery-operated steam feature or aerosol sprayer may be configured to release aromas into the bathing area.

Other embodiments or components may be considered herein, including such things as specially designed travel containers/covers for when not in use or for portability, additional types, designs, or placements of foot contacting portions 112, disassembly or folding-up design implements to allow for greater portability, and so on.

Figure 17A:
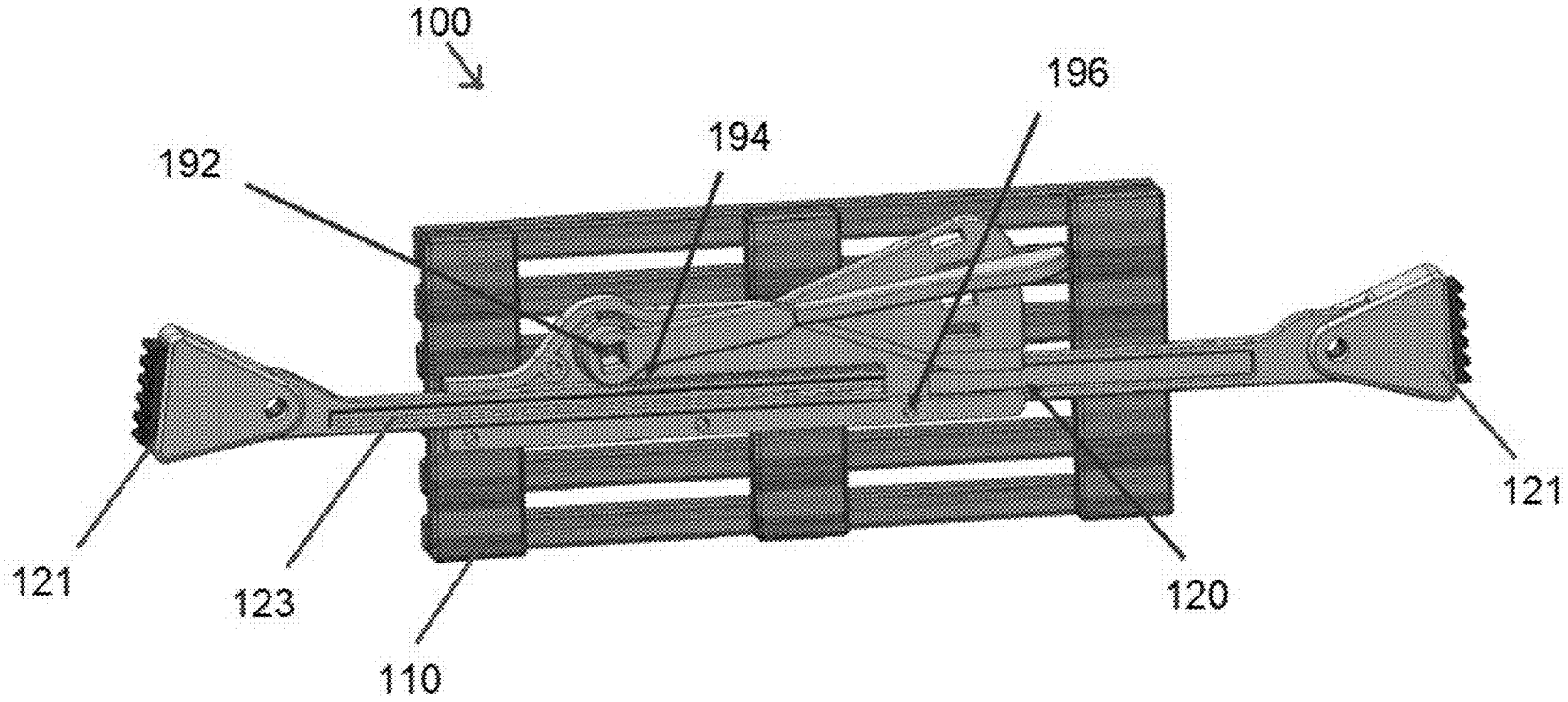
FIGS. 17A-17B illustrate another example embodiment of the bathtub platform insert with lever-assisted extending securing members in accordance with one or more embodiments of the present disclosure.
Figure 17B:
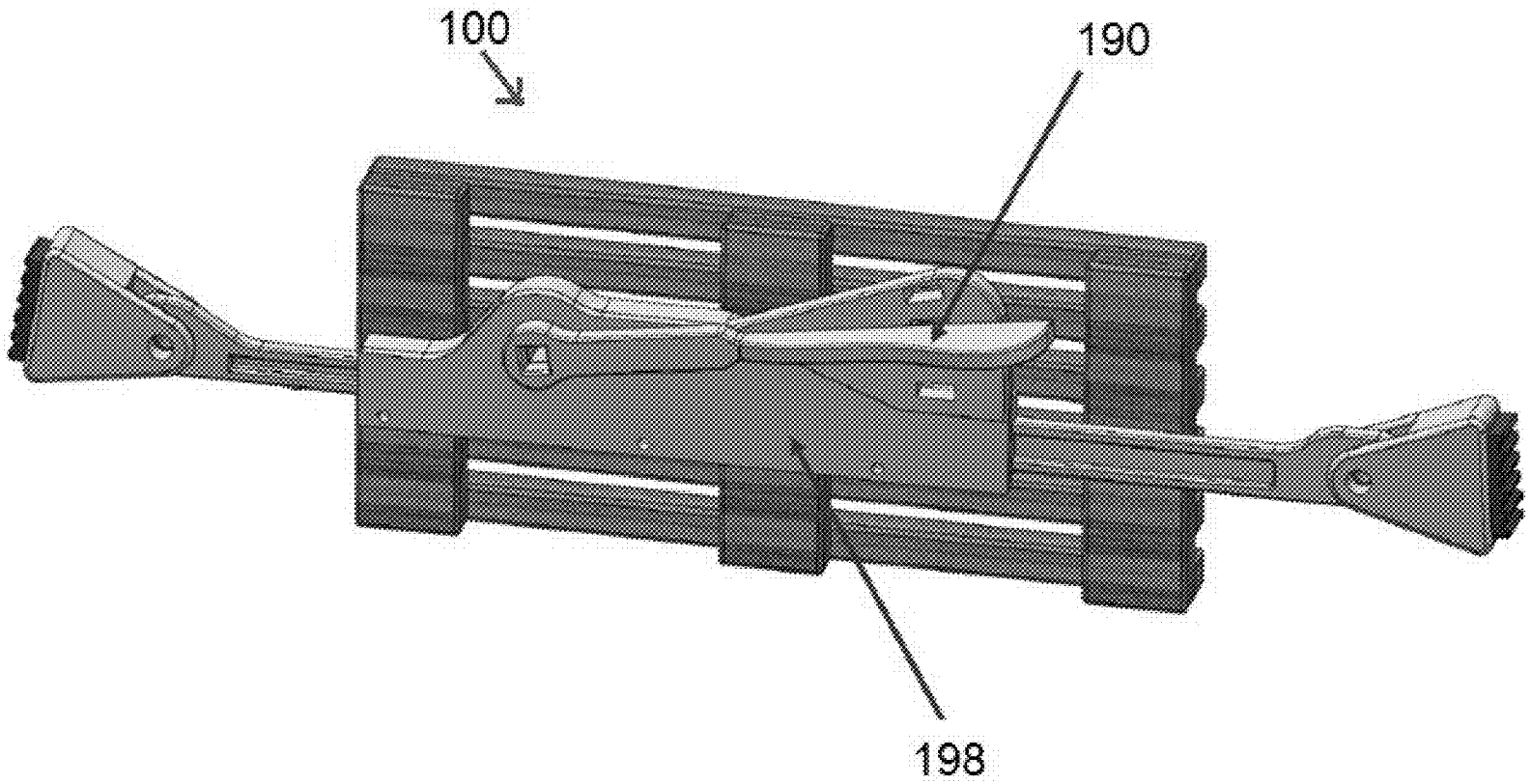

FIGS. 17A-17B illustrate another example embodiment of the bathtub platform insert 100 with lever-assisted extending securing members in accordance with one or more embodiments of the present disclosure. For instance, as shown from the rear surface of the support platform 110 (e.g., shown as a collection of wooden slats in one example), the securing member 120 (attached to the platform via one or more fasteners 196) and an opposing extension portion 123 (with respective opposing end pieces) may be extended to widen the securing member to apply tension to the sides of the tub wall. A lever 190 may be positioned to allow free movement of the extension portion 123 or to apply force via pivot gears 192 to a gear track 194 along the extension portion to press further tension against the opposing end pieces, and becoming locked in place via mating apertures on the assembly. A cover 198 may be used to hide the gear assembly for safety of the user.

Figure 18A:
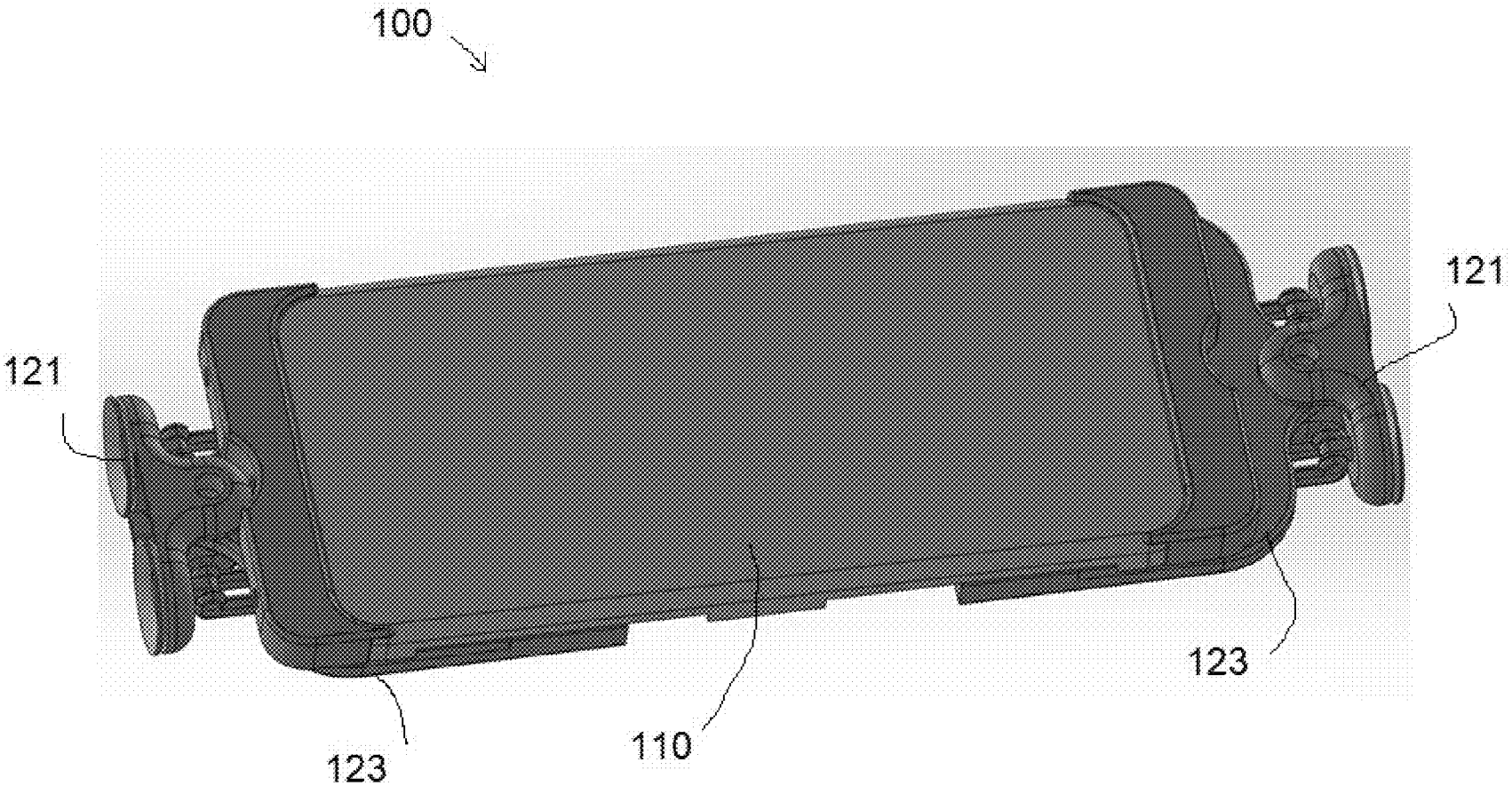
FIGS. 18A-18B illustrate another example embodiment of the bathtub platform insert with extending securing members with suction cup end pieces in accordance with one or more embodiments of the present disclosure.
Figure 18B:
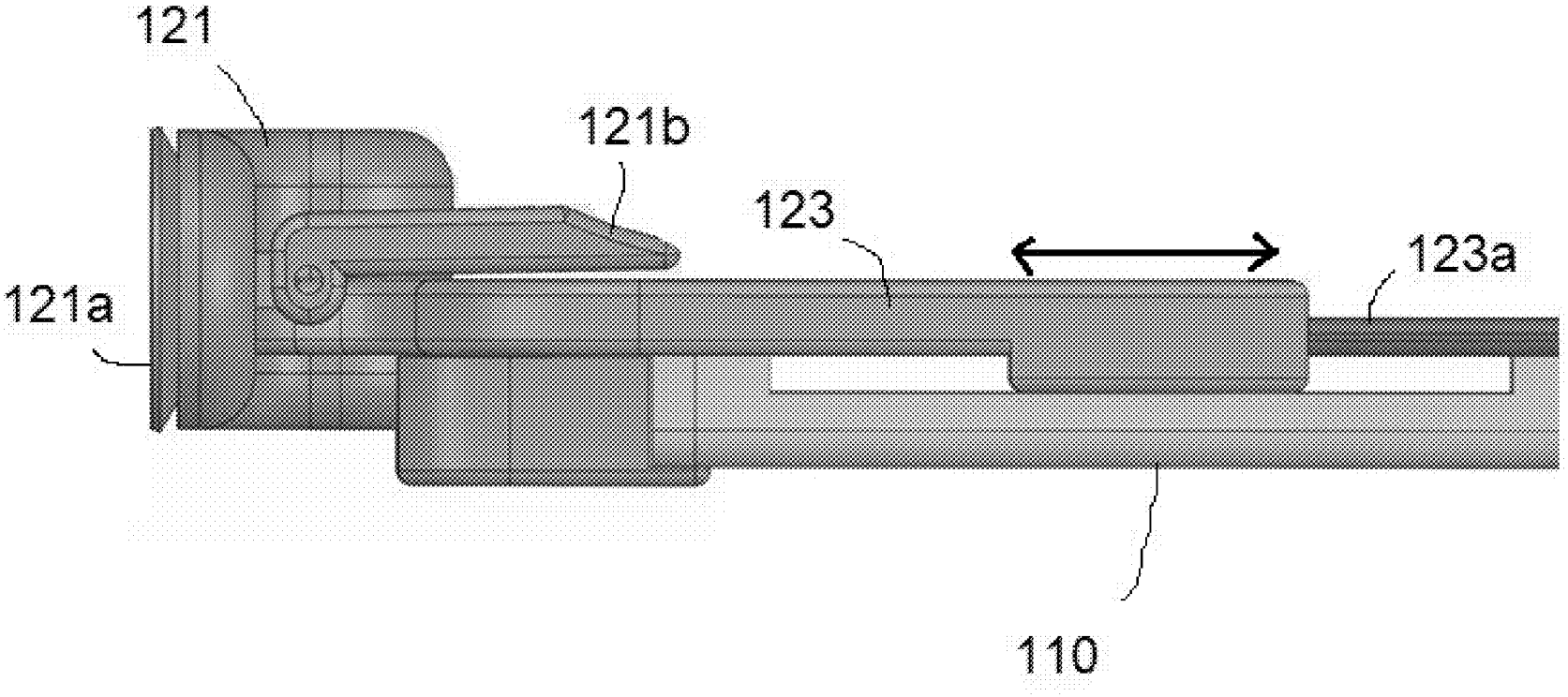

FIGS. 18A-18B illustrate another example embodiment of the bathtub platform insert 100 with extending securing members with suction cup end pieces in accordance with one or more embodiments of the present disclosure. For instance, as shown the end pieces 121 (e.g., two suction cups on either side, in one specific embodiment) may be pivotally attached to the securing/extension members 123 (or 120), which may be slidingly engaged to the support surface/platform 110. For instance, as shown specifically in FIG. 18B, the extension member 123 may be supported by an engaging member 123*a* of the rear surface of the support surface/platform 110, allowing free movement along the plane of the surface 110. The suction cups 121*a* (of end piece 121) may be lever-assisted (e.g., lever 121*b* applying suction force to the suction cups), as may be appreciated by those skilled in the art. According to the embodiment in FIGS. 18A-18B, therefore, the techniques herein allow the bathtub platform insert/assembly 100 to be widened to the width of the tub 200, such that the suction cups 121*a* may be stuck/adhered to the tub walls, securely holding the platform 100 in place, accordingly.

Figure 19A:
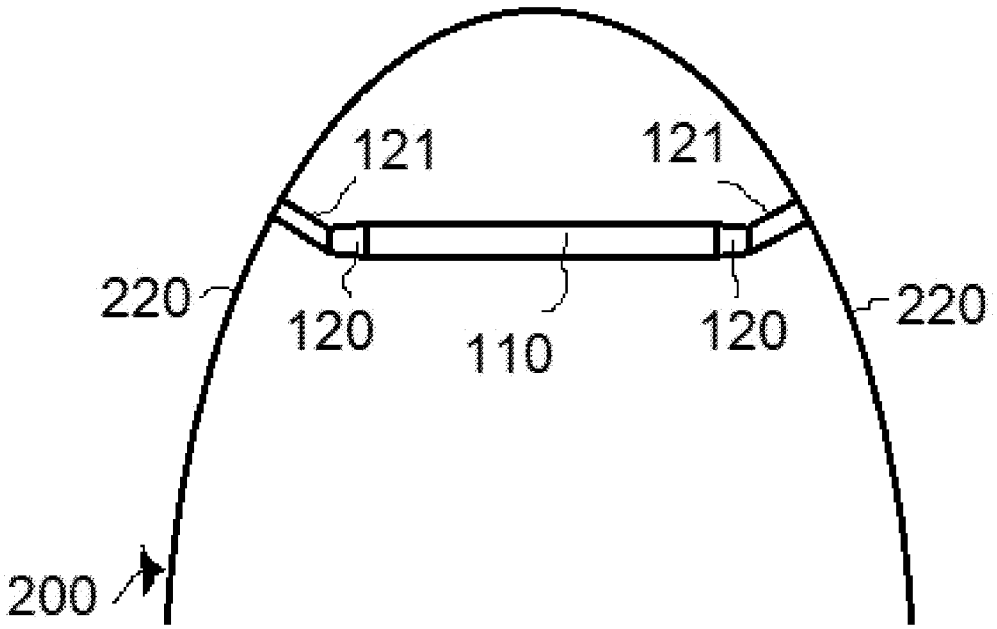
FIGS. 19A-19C illustrate another example embodiment of the bathtub platform insert with angled suction cup end pieces to account for certain tub curvatures in accordance with one or more embodiments of the present disclosure.
Figure 19C:
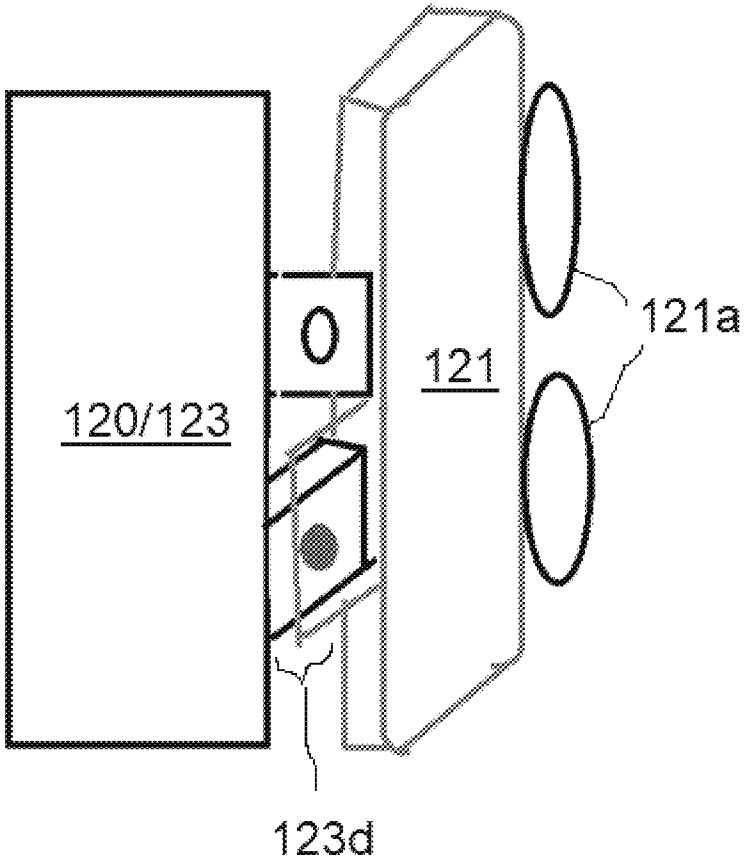
Figure 19B:
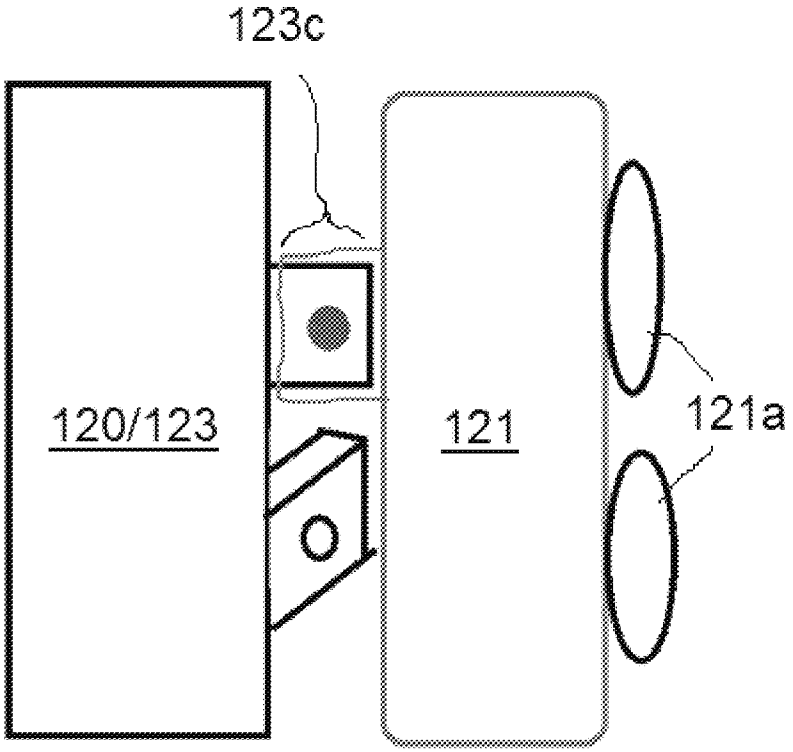

FIGS. 19A-19C illustrate another example embodiment of the bathtub platform insert with angled suction cup end pieces to account for certain tub curvatures in accordance with one or more embodiments of the present disclosure. For instance, as shown in FIG. 19A, certain tubs 200 have curved side walls 220 that may be difficult for adhesion by straight suction cups or other end pieces 121. For instance, by extension of securing members 120 from the support surface/platform 110, the angle of the end pieces 121 may not be able to apply appropriate tension or suction against the walls of the tub. Therefore, according to this embodiment, the end pieces (e.g., the end pieces 121 themselves or a portion of the securing members 120) may be angled toward the back surface of the platform 100 in order to accommodate the curvature of the tub. In certain embodiments, as shown in FIG. 19B-19C, in addition to merely being statically configured in this manner, the embodiments herein may provide for a reconfiguration mechanism, such as a locking hinge, or as shown, different attachment points 123*c* (straight) and 123*d* (angled) to account for different shaped bathtubs with the same packaged assembly.

Figure 20:
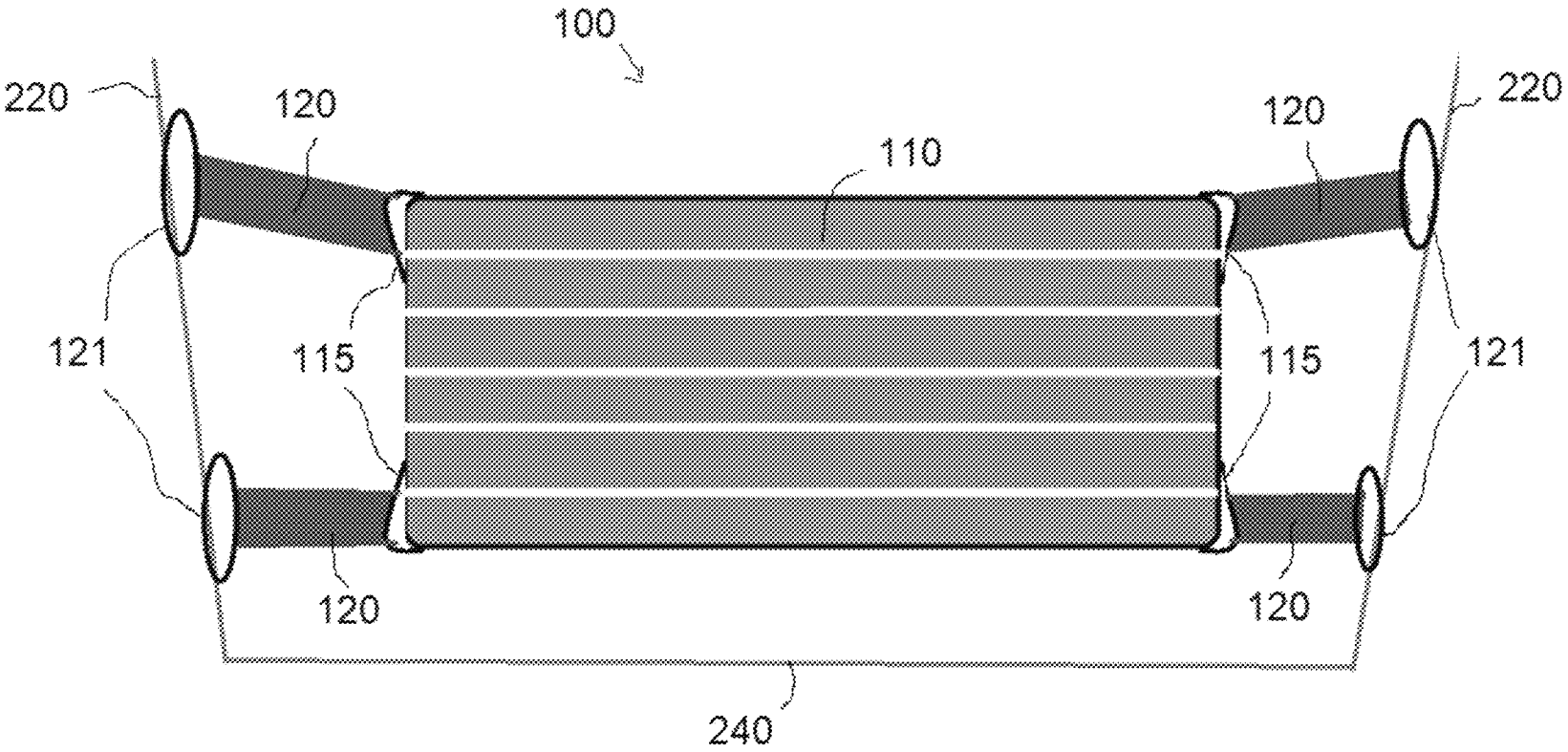
FIG. 20 illustrates another example embodiment of the bathtub platform insert with flexible support members with suction cup end pieces in accordance with one or more embodiments of the present disclosure.

FIG. 20 illustrates another example embodiment of the bathtub platform insert 100 with flexible support members 120 with suction cup end pieces 121 in accordance with one or more embodiments of the present disclosure. For instance, where one or more of the adjustable securing members 120 comprise flexible members (e.g., straps, cords, ropes, strings, bands, etc.), then gripping end pieces 121 of the flexible members may specifically comprise one or more suction cups (e.g., preferably with lever-assisted suction, as noted above), providing a hanging force between the end pieces, rather than a tension force. To tension the flexible members, various techniques may be used, such as, e.g., encircling hook and loop fastener straps (returning and fastening to itself) such as VELCRO® brand or otherwise, other types of strap securing mechanisms, simple knots, cable retracting mechanisms, and so on. To connect the one or more flexible support members 120 to the support surface 110, the one or more fastening mechanisms 115 may be used, such as rings connected to the support surface, apertures built within the support surface, screws, bolts, snaps, adhesives, and so on. Note that while the fastening mechanisms are shown attached directly to the support surface 110, other embodiments may have a component of extendible and rigid support members with a portion consisting of flexible support members, where the extendible rigid portion is configured to lock in place. Also, while the placement of the fastening systems is shown generally at the four corners of the support platform, such placement is merely an example, and not meant to limit the options for such placement according to the embodiments herein.

Figure 21:
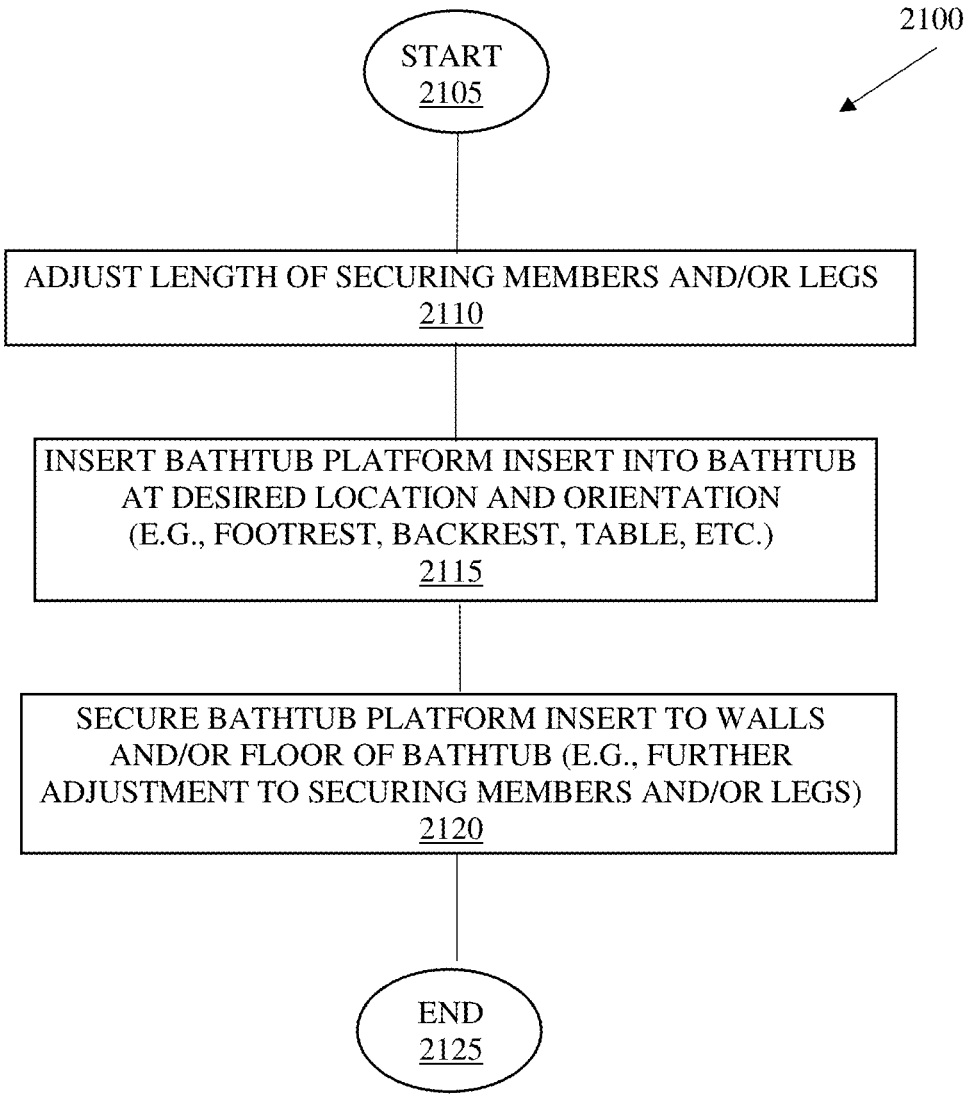
FIG. 21 illustrates an example simplified procedure for operating a bathtub platform insert in accordance with one or more embodiments of the present disclosure.

FIG. 21 illustrates an example simplified procedure for operating a bathtub platform insert 100 in accordance with one or more embodiments described herein. Procedure 2100 may start at step 2105 and continue to step 2110, where, as described in greater detail above, a bather may adjust the length of securing members 120 and/or legs 130 to the appropriate size for the width and location of the bathtub 200. In step 2115 the bather may then insert the bathtub platform insert 100 into bathtub 200 at desired location and orientation (e.g., as a footrest, backrest, table, etc.), and in step 2120 secures the bathtub platform insert to walls 220 and/or floor 240 of bathtub (e.g., performing further adjustment to the securing members and/or legs to affix the footrest into position). The simplified procedure 2100 then ends in step 2125.

It should be noted that the steps shown and described in the procedure(s) above are merely examples for illustration, and certain other steps may be included or excluded as desired. Further, while a particular order of the steps is shown, this ordering is merely illustrative, and any suitable arrangement of the steps may be utilized without departing from the scope of the embodiments herein.

Advantageously, the techniques herein provide a bathtub platform insert, such as a bathtub footrest insert that allows for customizable and comfortable resizing of the effective length of a bathtub. In particular, the present disclosure provides a bathtub footrest insert that allows a bather of below average height to enjoy a relaxing bath without fear of or struggling against having his/her head sink below the water. Also, many embodiments herein may be enjoyed by any sized bathers, such as those who merely wish to elevate their feet, or have a massaging texture, or other accessories in their bath. Furthermore, certain embodiments of the bathtub platform insert may be configured and/or used as a table/shelf, which may be placed at any desired position (lengthwise and height), and that may account for differently shaped bathtubs, accordingly.

While the present disclosure has illustrated various embodiments of the bathtub platform insert, other configurations may be made within the scope of the invention. For instance, while certain materials have been shown for each component, other suitable materials may be used. Furthermore, while certain shapes or designs of the components have been shown and described, functionally similar designs may also be utilized herein. Moreover, while components of the present disclosure may be described separately and in separate figures, certain components from each embodiment may be incorporated into each other embodiment, and the components shown in each of the illustrations are not meant to be mutually exclusive. That is, various combinations of components may be made with the scope of the present disclosure by combining the described components in useful manners.

Specifically, in one embodiment, an illustrative bathtub platform (footrest, backrest, table, etc.) insert (i.e., an apparatus), comprises: a support surface, the support surface being generally planar and rigid and having a width between a first side edge and a second side edge within a range of 12-32 inches, a height between a top edge and a bottom edge within a range of 8-16 inches, and a depth between a front surface and a rear surface not greater than 4 inches; one or more adjustable securing members connected to the support surface and extending outwardly widthwise from the support surface from the first side edge and the second side edge of the support surface; and one or more gripping end pieces on each end of the one or more adjustable securing members; wherein the one or more adjustable securing members are adjustable to extend an overall width of the bathtub platform insert between one or more opposing pairs of gripping end pieces to secure the one or more opposing pairs of gripping end pieces against a wall of a bathtub.

In one embodiment, one or more of the one or more gripping end pieces comprise a rubber foot.

In one embodiment, one or more of the one or more gripping end pieces comprise a suction cup. In one embodiment, the suction cup comprises a lever-assisted suction cup.

In one embodiment, one or more of the one or more adjustable securing members comprise extending and locking members, and wherein the one or more opposing pairs of gripping end pieces secure against the wall of the bathtub through tension. In one embodiment, the extending and locking members are arranged in a configuration selected from a group consisting of: within an interior the support surface; and affixed to the rear surface of the support surface. In one embodiment, the extending and locking members are arranged in a configuration selected from a group consisting of: singular members between opposing pairs of gripping end pieces; and separated and opposing members between opposing pairs of gripping end pieces.

In one embodiment, one or more of the one or more adjustable securing members comprise flexible members, and wherein the one or more gripping end pieces of the flexible members comprise one or more suction cups. In one embodiment, the flexible members comprise straps. In one embodiment, the straps comprise encircled hook and loop fasteners. In one embodiment, the bathtub platform insert further comprises: one or more fastening mechanisms to connect the flexible members to the support surface, the one or more fastening mechanisms selected from a group consisting of: rings connected to the support surface; and apertures within the support surface.

In one embodiment, the one or more gripping end pieces are angled toward the rear surface of the support surface.

In one embodiment, the support surface comprises a plurality of portions of different textures.

In one embodiment, the bathtub platform insert further comprises: one or more legs extending from the rear surface of the support surface.

In one embodiment, the bathtub platform insert further comprises: a grip member on the bottom edge of the support surface.

In one embodiment, the bathtub platform insert further comprises: one or more legs extending from the bottom edge of the support surface.

In one embodiment, the bathtub platform insert further comprises: one or more accessory mounts.

In one embodiment, the bathtub platform insert further comprises: a removeable cover over at least the support surface.

In one embodiment, the bathtub platform insert further comprises: one or more rollers embedded in the support surface.

In one embodiment, the bathtub platform insert further comprises: a watertight battery compartment; and one or more battery operated mechanisms electrically connected to the watertight battery compartment.

The foregoing description has been directed to specific embodiments. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true intent and scope of the embodiments herein.

What is claimed is:

1. A bathtub platform insert, comprising:

a support surface, the support surface being generally planar and rigid and having a width between a first side edge and a second side edge within a range of 12-32 inches, a height between a top edge and a bottom edge within a range of 8-16 inches, and a depth between a front surface and a rear surface not greater than 4 inches;

one or more adjustable securing members connected to the support surface and extending outwardly widthwise from the support surface from the first side edge and the second side edge of the support surface; and one or more gripping end pieces on each end of the one or more adjustable securing members;

wherein the one or more adjustable securing members are adjustable to extend an overall width of the bathtub platform insert between one or more opposing pairs of gripping end pieces to secure the one or more opposing pairs of gripping end pieces against a wall of a bathtub.

2. The bathtub platform insert as in claim 1, wherein one or more of the one or more gripping end pieces comprise a rubber foot.

3. The bathtub platform insert as in claim 1, wherein one or more of the one or more gripping end pieces comprise a suction cup.

4. The bathtub platform insert as in claim 3, wherein the suction cup comprises a lever-assisted suction cup.

5. The bathtub platform insert as in claim 1, wherein one or more of the one or more adjustable securing members comprise extending and locking members, and wherein the one or more opposing pairs of gripping end pieces secure against the wall of the bathtub through tension.

6. The bathtub platform insert as in claim 5, wherein the extending and locking members are arranged in a configuration selected from a group consisting of: within an interior the support surface; and affixed to the rear surface of the support surface.

7. The bathtub platform insert as in claim 5, wherein the extending and locking members are arranged in a configuration selected from a group consisting of: singular members between opposing pairs of gripping end pieces; and separated and opposing members between opposing pairs of gripping end pieces.

8. The bathtub platform insert as in claim 1, wherein one or more of the one or more adjustable securing members comprise flexible members, and wherein the one or more gripping end pieces of the flexible members comprise one or more suction cups.

9. The bathtub platform insert as in claim 8, wherein the flexible members comprise straps.

10. The bathtub platform insert as in claim 9, wherein the straps comprise encircled hook and loop fasteners.

11. The bathtub platform insert as in claim 8, further comprising:

one or more fastening mechanisms to connect the flexible members to the support surface, the one or more fastening mechanisms selected from a group consisting of: rings connected to the support surface; and apertures within the support surface.

12. The bathtub platform insert as in claim 1, wherein the one or more gripping end pieces are angled toward the rear surface of the support surface.

13. The bathtub platform insert as in claim 1, wherein the support surface comprises a plurality of portions of different textures.

14. The bathtub platform insert as in claim 1, further comprising:

one or more legs extending from the rear surface of the support surface.

15. The bathtub platform insert as in claim 1, further comprising:

a grip member on the bottom edge of the support surface.

16. The bathtub platform insert as in claim 1, further comprising:

one or more legs extending from the bottom edge of the support surface.

17. The bathtub platform insert as in claim 1, further comprising:

one or more accessory mounts.

18. The bathtub platform insert as in claim 1, further comprising:

a removeable cover over at least the support surface.

19. The bathtub platform insert as in claim 1, further comprising:

one or more rollers embedded in the support surface.

20. The bathtub platform insert as in claim 1, further comprising:

a watertight battery compartment; and one or more battery operated mechanisms electrically connected to the watertight batter compartment.

* * * * *